US010252526B2

(12) United States Patent
Tamai

(10) Patent No.: US 10,252,526 B2
(45) Date of Patent: Apr. 9, 2019

(54) NOZZLE PLATE, LIQUID DISCHARGE HEAD, LIQUID DISCHARGE DEVICE, AND APPARATUS FOR DISCHARGING LIQUID

(71) Applicant: Tomohiro Tamai, Kanagawa (JP)

(72) Inventor: Tomohiro Tamai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/510,763

(22) PCT Filed: Oct. 22, 2015

(86) PCT No.: PCT/JP2015/005322
§ 371 (c)(1),
(2) Date: Mar. 13, 2017

(87) PCT Pub. No.: WO2016/063539
PCT Pub. Date: Apr. 28, 2016

(65) Prior Publication Data

US 2017/0274652 A1 Sep. 28, 2017

(30) Foreign Application Priority Data

Oct. 25, 2014 (JP) ..... 2014-217870
Jul. 24, 2015 (JP) ..... 2015-146971

(51) Int. Cl.
*B41J 2/14* (2006.01)
*B41J 2/16* (2006.01)

(52) U.S. Cl.
CPC ..... *B41J 2/1433* (2013.01); *B41J 2/1606* (2013.01); *B41J 2/1612* (2013.01); *B41J 2/1629* (2013.01);
(Continued)

(58) Field of Classification Search
USPC ..... 347/47, 51, 52
See application file for complete search history.

(56) References Cited

U.S. PATENT DOCUMENTS 7,247,198 B2 7/2007 Fujioka et al.
8,303,083 B2 11/2012 Fujii et al.
(Continued)

FOREIGN PATENT DOCUMENTS

JP H07-117224 5/1995
JP 2003-277651 10/2003
(Continued)

OTHER PUBLICATIONS

International Search Report dated Jan. 12, 2016 in PCT/JP2015/005322 filed on Oct. 22, 2015.
(Continued)

*Primary Examiner* — Lam S Nguyen
(74) *Attorney, Agent, or Firm* — Cooper & Dunham LLP

(57) ABSTRACT

A nozzle plate includes a nozzle base member including a plurality of nozzle holes formed therethrough, the plurality of nozzle holes serving as nozzles that discharge droplets; and a liquid-repellent film of a liquid-repellent material formed on a droplet discharge surface of the nozzle base member, the liquid-repellent material containing a liquid-repellent group. Each of the plurality of nozzle holes includes a straight hole part, the straight hole part extending from the droplet discharge surface of the nozzle base member and having a constant diameter in a thickness direction of the nozzle base member. The liquid-repellent group contained in the liquid-repellent material is attached to an inner nozzle wall of the straight hole part. When the nozzle hole is supplied with pure water, a meniscus of the pure water stays in the straight hole part.

15 Claims, 16 Drawing Sheets

(52) U.S. Cl.
CPC ..... *B41J 2002/14403* (2013.01); *B41J 2002/14475* (2013.01)

(56) References Cited

U.S. PATENT DOCUMENTS

| | | | | |
|---|---|---|---|---|
| 8,343,712 | B2 | 1/2013 | Hamade et al. | |
| 8,870,346 | B2 | 10/2014 | Kimura | |
| 9,150,697 | B2 | 10/2015 | Sawada et al. | |
| 2006/0214993 | A1* | 9/2006 | Iwata | B41J 11/002 347/52 |
| 2009/0114121 | A1 | 5/2009 | Morohashi et al. | |
| 2013/0027470 | A1* | 1/2013 | Kato | B41J 2/14233 347/45 |

FOREIGN PATENT DOCUMENTS

| | | |
|---|---|---|
| JP | 2008-001003 | 1/2008 |
| JP | 2008-284579 | 11/2008 |
| JP | 2009-214338 | 9/2009 |
| JP | 2009-214388 | 9/2009 |
| JP | 2010-076422 | 4/2010 |
| JP | 2010-105163 | 5/2010 |
| JP | 2013-006297 | 1/2013 |
| JP | 2013-237259 | 11/2013 |
| JP | 2014-054788 | 3/2014 |
| JP | 5539155 | 7/2014 |

OTHER PUBLICATIONS

International Preliminary Report on Patentability dated Apr. 25, 2017 in connection with PCT/JP2015/005322.

* cited by examiner

[Fig. 1]
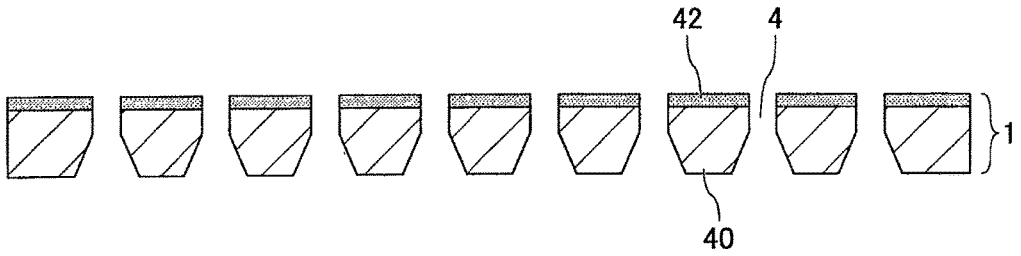
[Fig. 2]
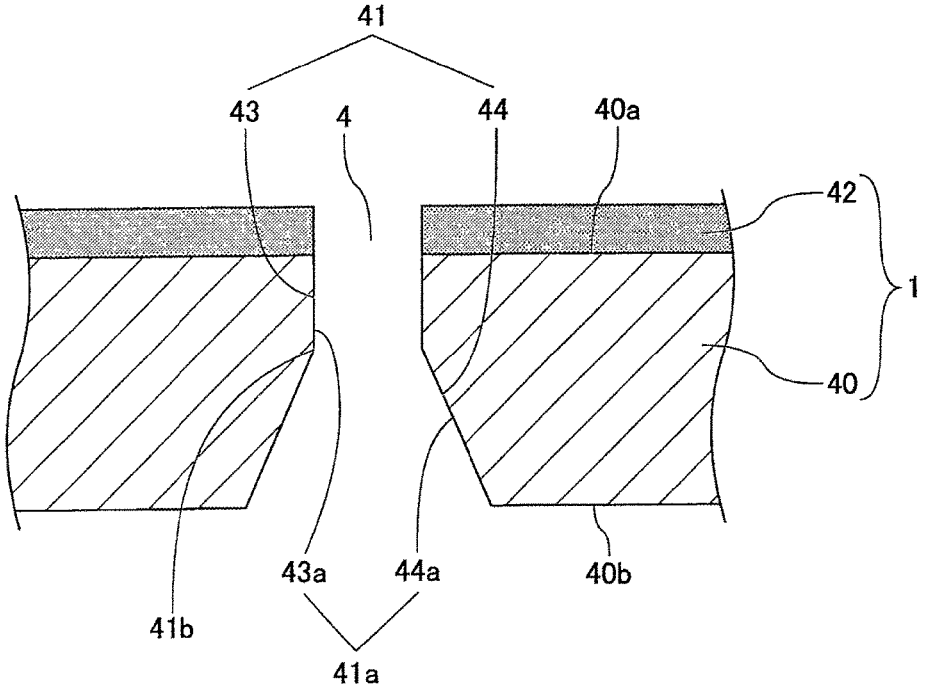

[Fig. 3]
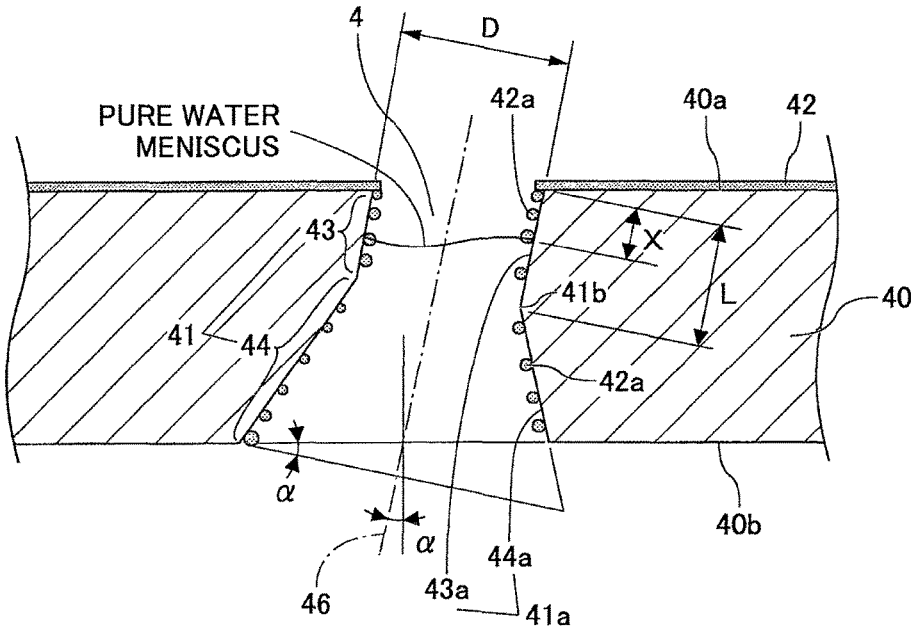
[Fig. 4]
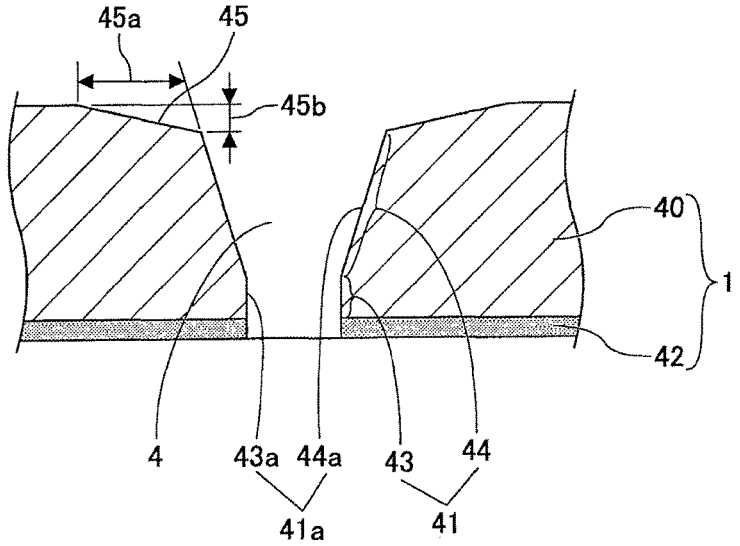

[Fig. 5]

| | |
|---|---|
| UPSTREAM STEP | POLISH SURFACE OF NOZZLE BASE MEMBER |
| PRETREATMENT STEP | TREAT SURFACE OF NOZZLE BASE MEMBER WITH ULTRASONIC CLEANING |
| LIQUID-REPELLENT FILM FORMATION STEP | PREPARE DIPPING LIQUID TO FORM LIQUID-REPELLENT FILM |
| | TREAT SURFACE (DISCHARGE SURFACE) OF NOZZLE BASE MEMBER WITH PLASMA PROCESS |
| | DIP NOZZLE BASE MEMBER INTO DIPPING LIQUID TO FORM LIQUID-REPELLENT FILM |
| | LEAVE AT ROOM TEMPERATURE |
| | HEAT |
| | PERFORM ULTRASONIC CLEANING |
| POST-TREATMENT STEP | PROTECT SURFACE OF LIQUID-REPELLENT FILM USING LAMINATE MATERIAL |
| | TREAT BACK SURFACE OF NOZZLE BASE MEMBER WITH PLASMA PROCESS |
| DOWNSTREAM STEP | BOND NOZZLE PLATE TO CHANNEL PLATE |
| | HEAT AFTER BONDING |

[Fig. 6]

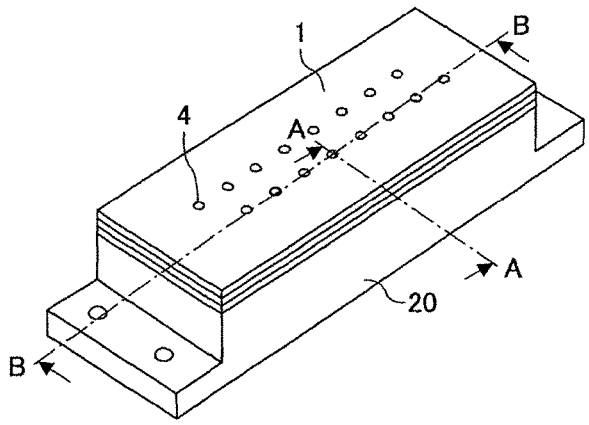

[Fig. 7]
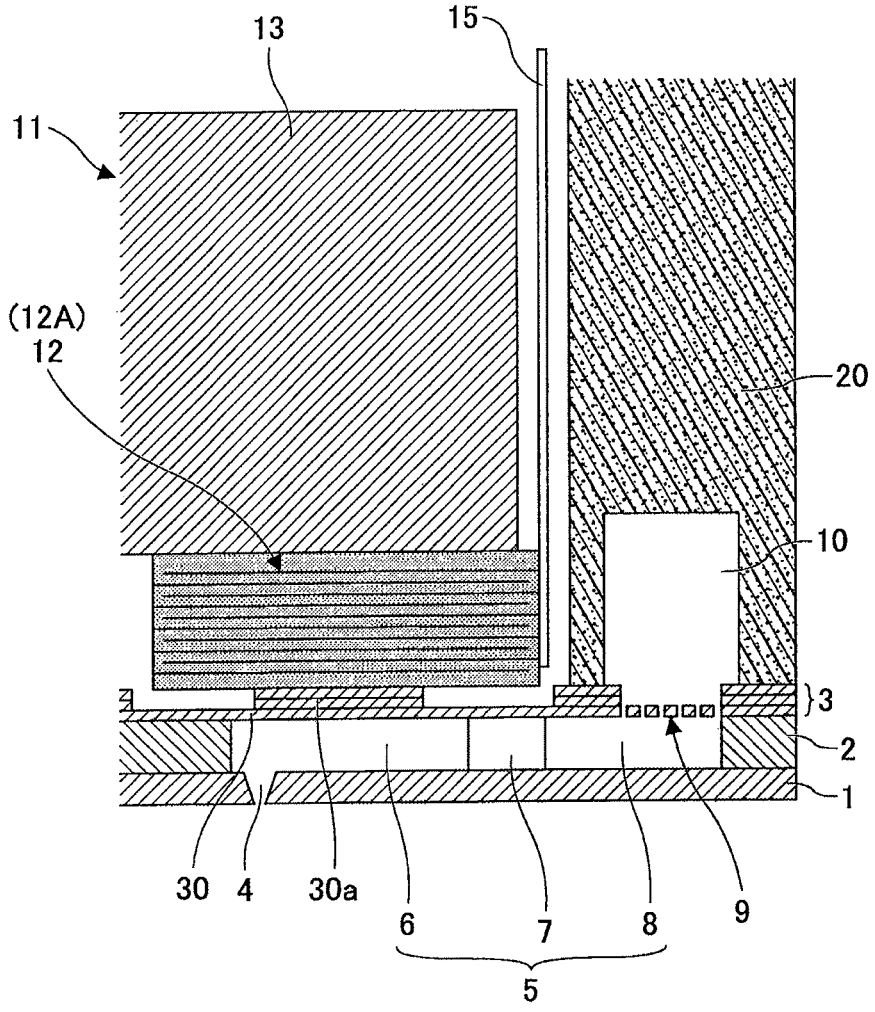

[Fig. 8]
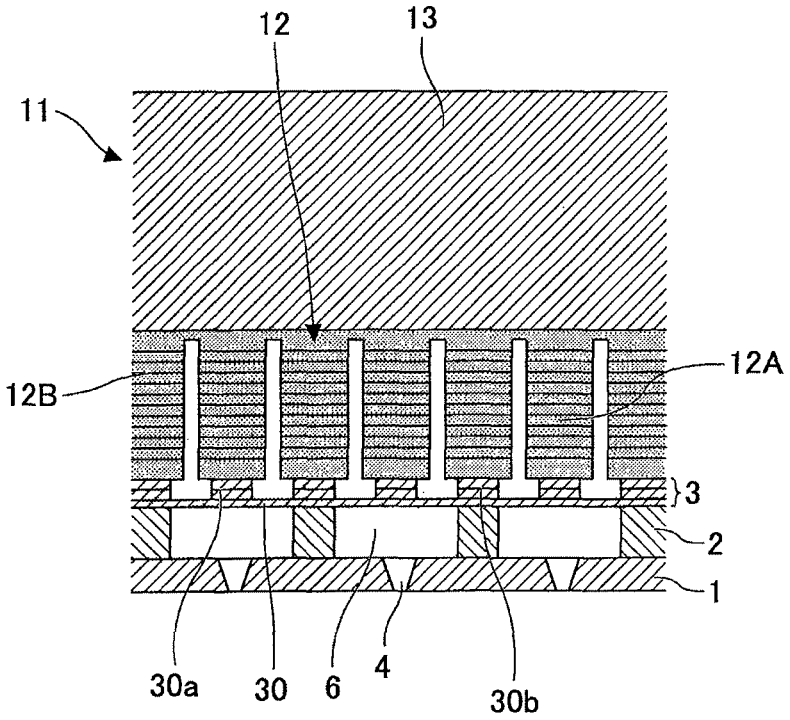

[Fig. 9]
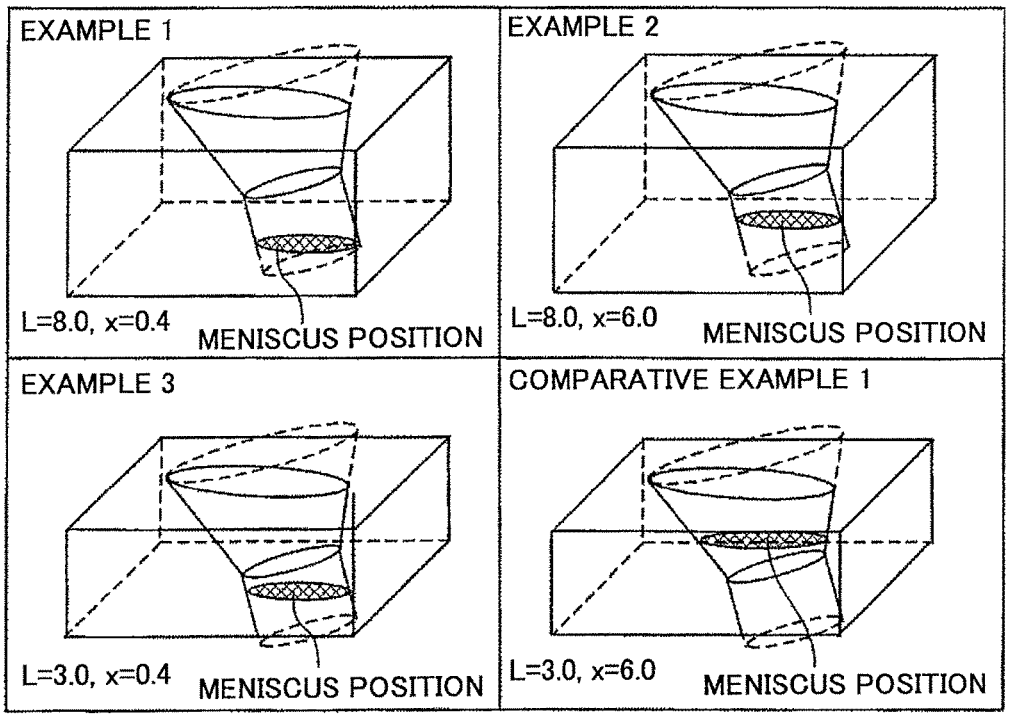

[Fig. 10]
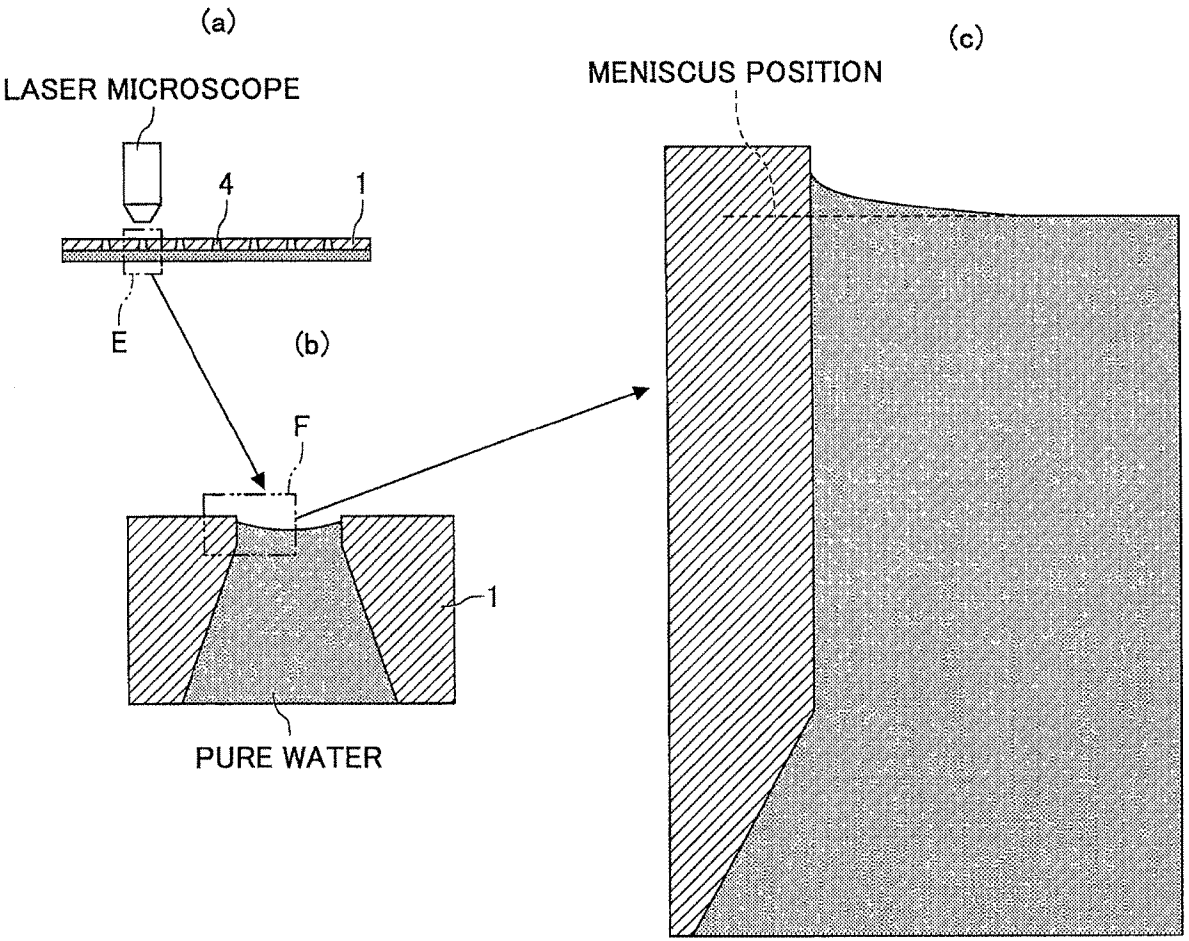

[Fig. 11]
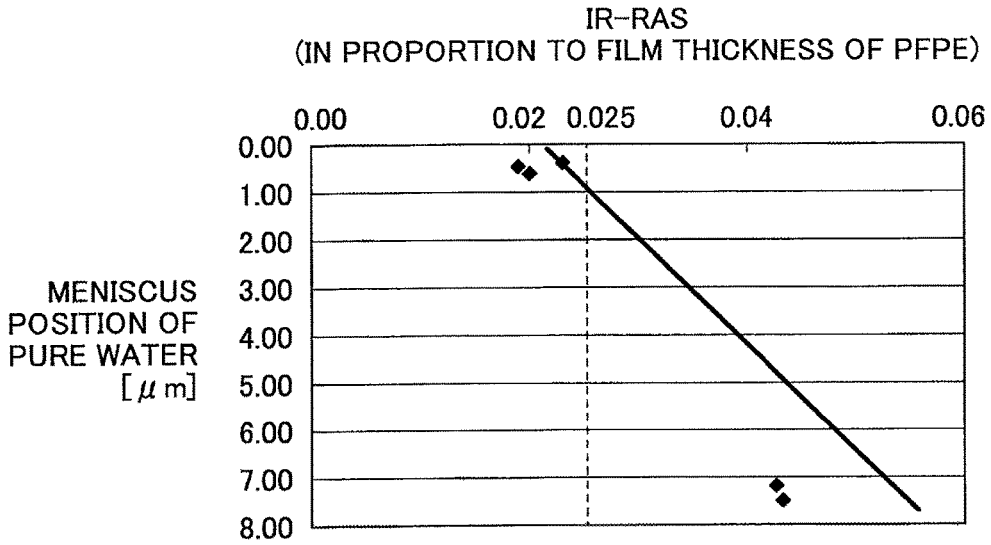

[Fig. 12A]
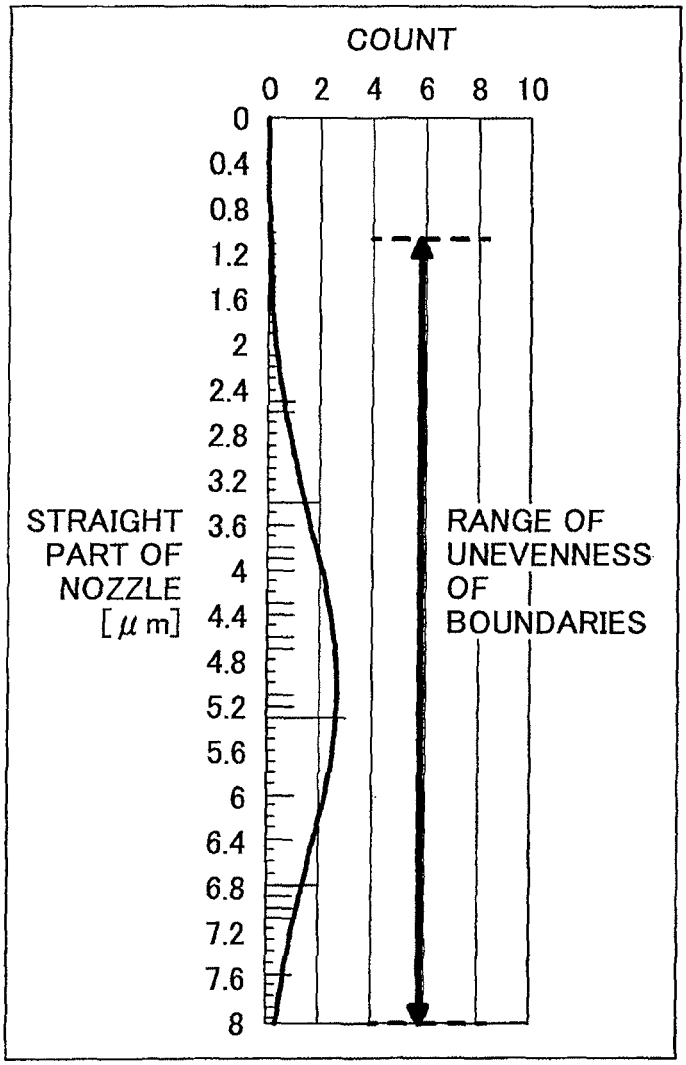

[Fig. 12B]
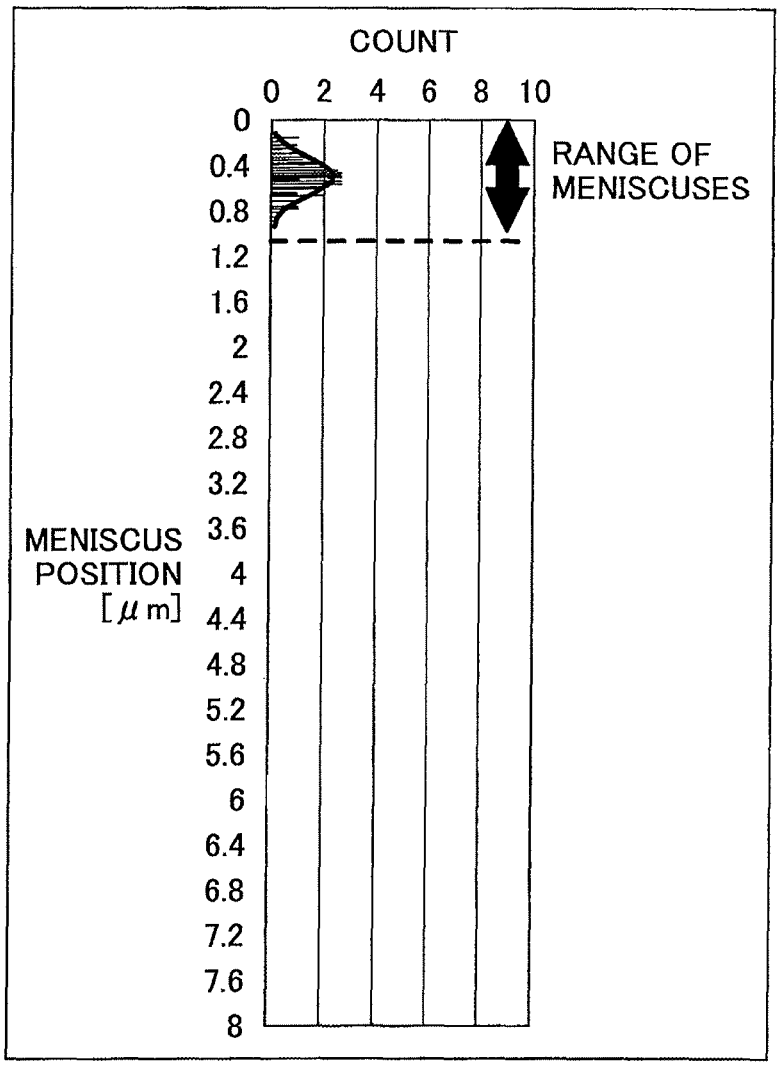

[Fig. 13]
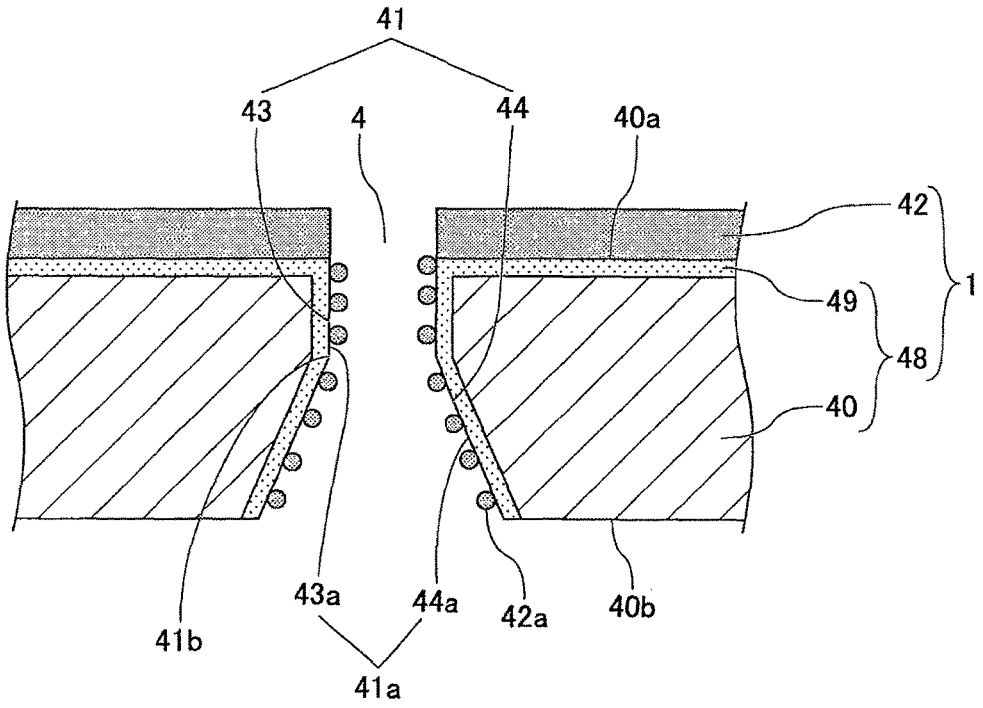
[Fig. 14]
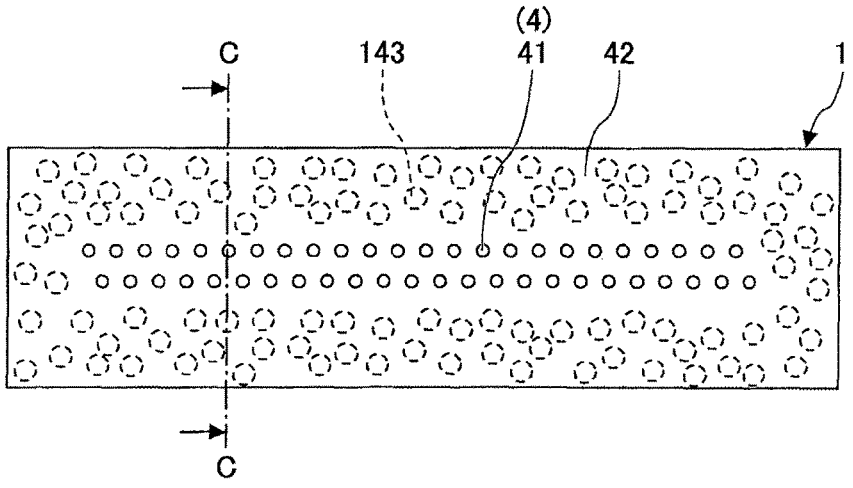

[Fig. 15]
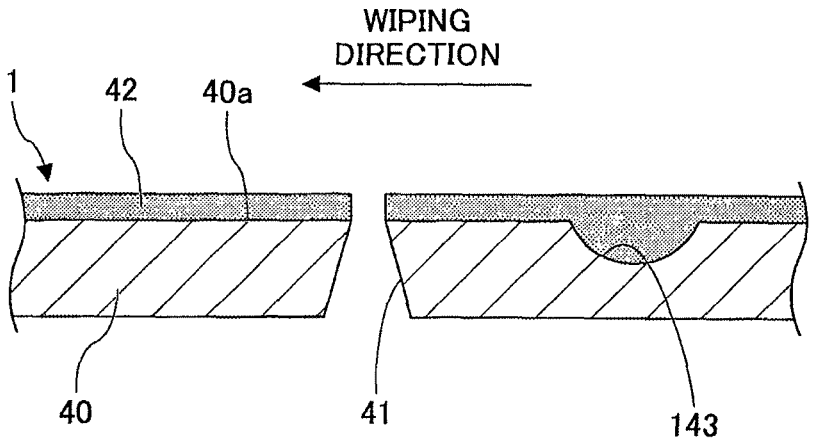
[Fig. 16]
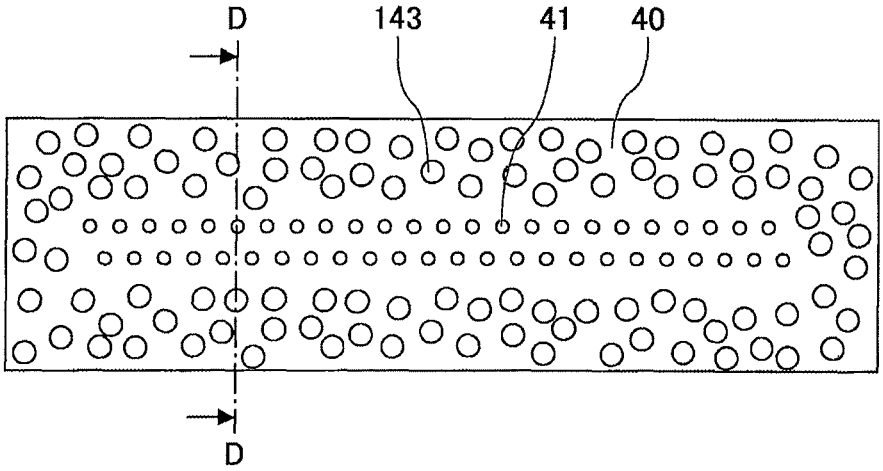

[Fig. 17]
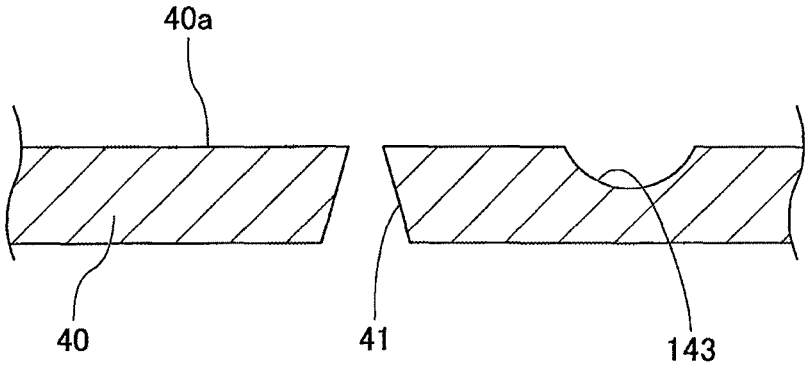
[Fig. 18]
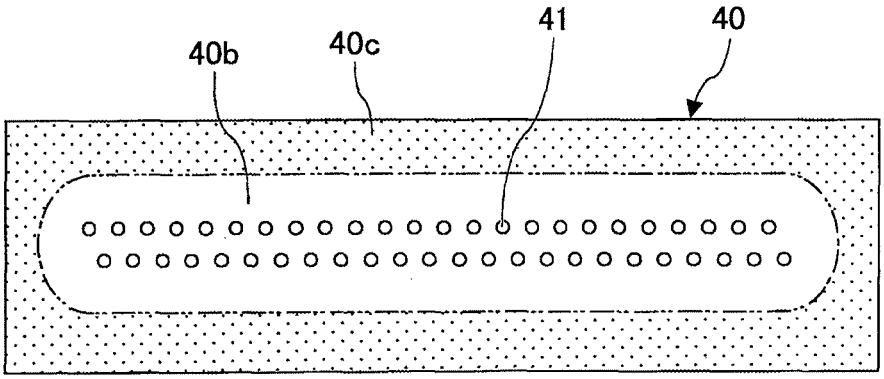

[Fig. 19]
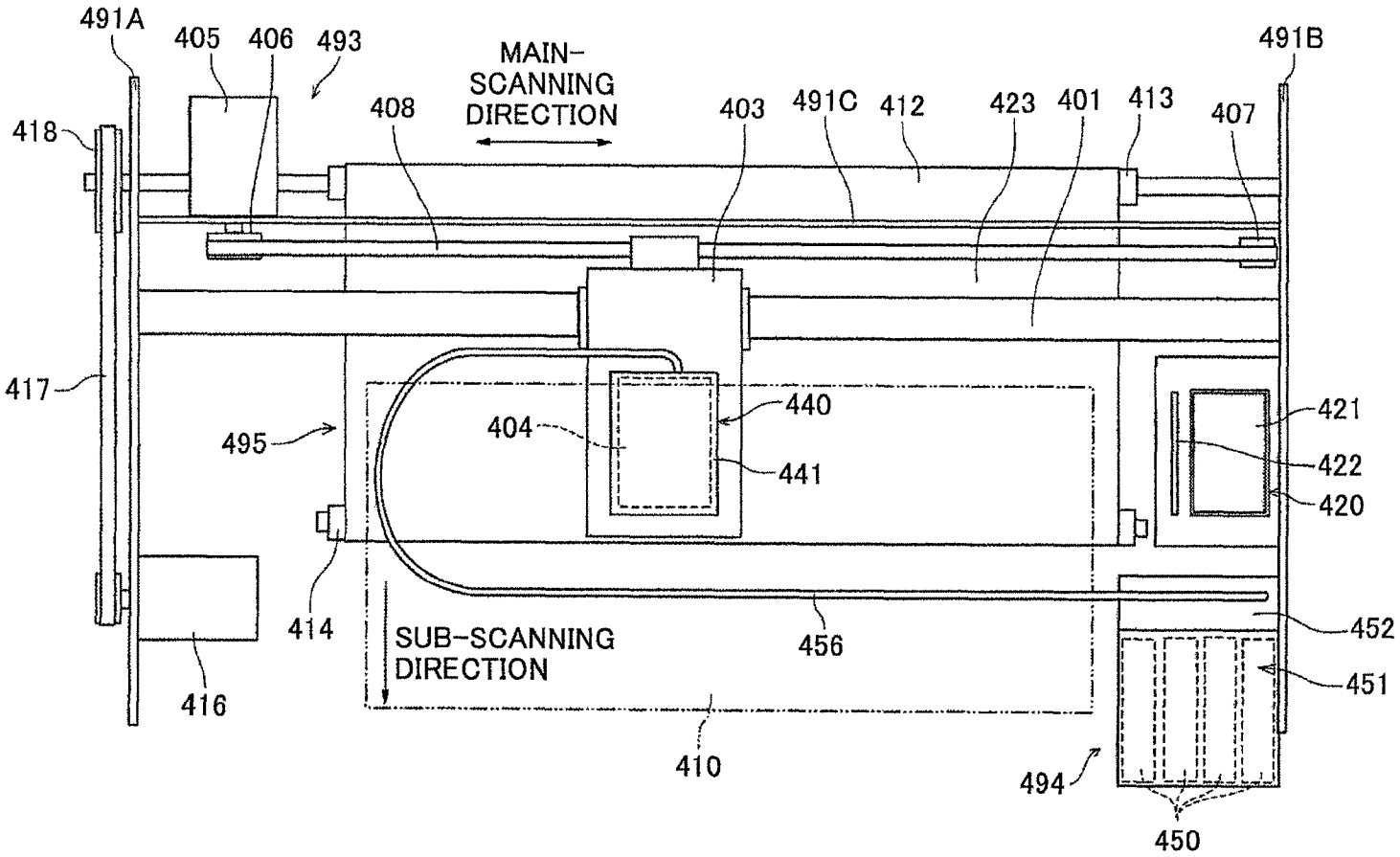

[Fig. 20]
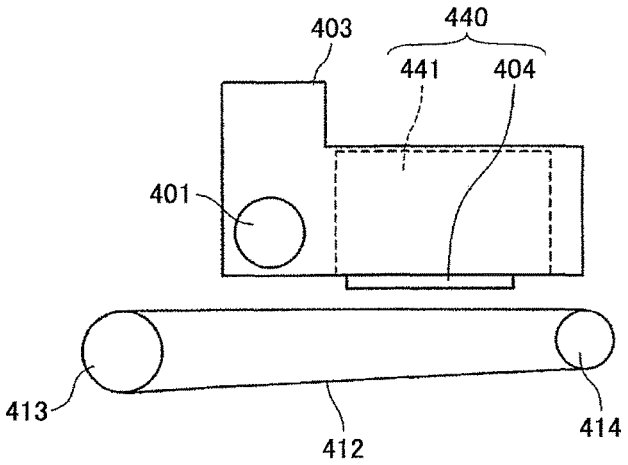
[Fig. 21]
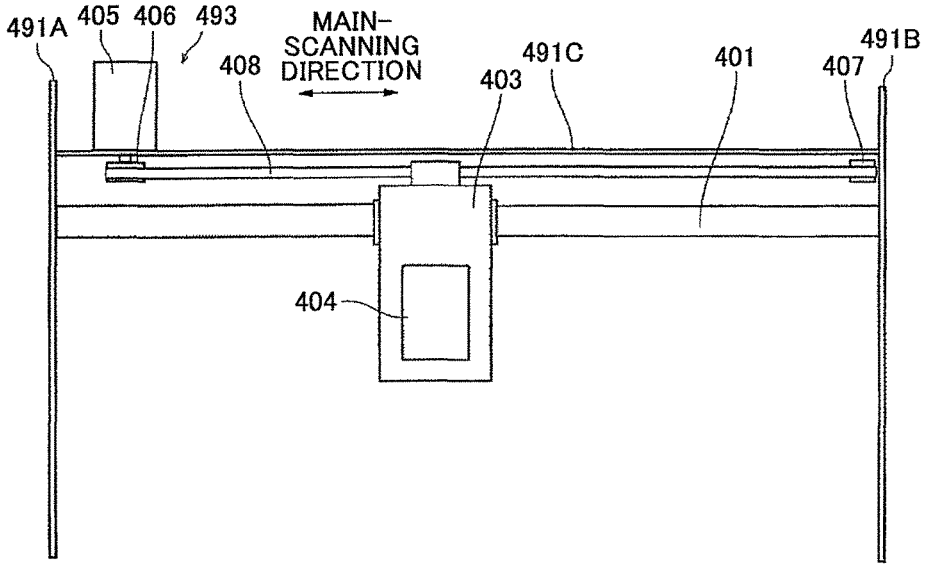

[Fig. 22]
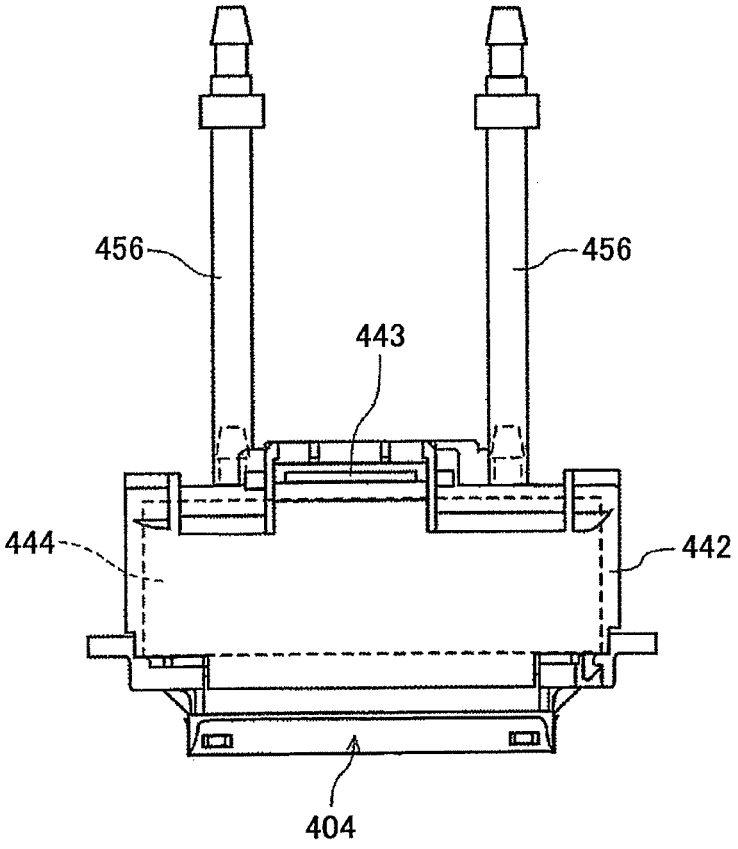

NOZZLE PLATE, LIQUID DISCHARGE HEAD, LIQUID DISCHARGE DEVICE, AND APPARATUS FOR DISCHARGING LIQUID

TECHNICAL FIELD

The present invention relates to a nozzle plate, a liquid discharge head, a liquid discharge device, and an apparatus for discharging liquid.

BACKGROUND ART

In a nozzle plate of a liquid discharge head that discharges droplets, a liquid-repellent film is formed on a droplet discharge surface (also simply referred to as "discharge surface") in order to perform stable droplet discharge.

For formation of such a liquid-repellent film, there are liquid-repellent materials that use a chemical compound having a perfluoropolyether (PFPE) skeleton in its molecules (PTL 1).

In some cases, a liquid-repellent film is formed on a face of a droplet discharge surface in a nozzle base member where nozzle holes serving as nozzles are formed and is formed at least on the droplet discharge surface of an inner wall of the nozzles. On a surface of the liquid-repellent film formed on the inner wall of the nozzles, numbers of liquid-repellent groups per unit area are successively reduced from the droplet discharge surface toward a side away from the droplet discharge surface (PTL 2).

CITATION LIST

Patent Literature

PTL 1: Japanese Laid-Open Patent Publication No. 2013-237259

PTL 2: Japanese Laid-Open Patent Publication No. 2014-054788

SUMMARY OF INVENTION

Technical Problem

Preferably, a liquid-repellent film for a nozzle plate is formed only on a surface (droplet discharge surface) of a nozzle base member in order to reduce a curved discharge direction and a fluctuation of droplet speed.

However, when a liquid-repellent material having high flowability such as PFPE mentioned above is used, even if a liquid-repellent film is formed only on the droplet discharge surface, liquid-repellent groups invade the inner nozzle wall due to a flow of the liquid-repellent material with the passage of time.

In this case, if there are a plurality of nozzles, a degree of the invasion of the inner nozzle wall by the liquid-repellent groups is not the same in all the nozzles. As a result, there is a problem in that meniscus positions are different in the nozzles and un-evenness of droplet discharge characteristics occurs.

In view of the above-mentioned problem, it is a general object of the present invention to provide a nozzle plate that reduces unevenness of droplet discharge characteristics due to a flow of a liquid-repellent material with the passage of time.

Solution to Problem

In an embodiment of the present invention, a nozzle plate is provided. The nozzle plate includes a nozzle base member including a plurality of nozzle holes formed therethrough, the plurality of nozzle holes serving as nozzles that discharge droplets; and a liquid-repellent film of a liquid-repellent material formed on a droplet discharge surface of the nozzle base member, the liquid-repellent material containing a liquid-repellent group. Each of the plurality of nozzle holes includes a straight hole part, the straight hole part extending from the droplet discharge surface of the nozzle base member and having a constant diameter in a thickness direction of the nozzle base member. The liquid-repellent group contained in the liquid-repellent material is attached to an inner nozzle wall of the straight hole part. When the nozzle hole is supplied with pure water, a meniscus of the pure water stays in the straight hole part.

Advantageous Effects of Invention

According to the present invention, it is possible to reduce unevenness of droplet discharge characteristics that results from a flow of a liquid-repellent material with the passage of time.

BRIEF DESCRIPTION OF DRAWINGS

FIG. 1 is a cross-sectional illustration of a nozzle plate according to a first embodiment of present invention.

FIG. 2 is an enlarged cross-sectional illustration of one nozzle in the nozzle plate.

FIG. 3 is a diagram illustrating liquid-repellent groups of a liquid-repellent material invading a nozzle hole and regulation of invasion positions.

FIG. 4 is a diagram illustrating another nozzle hole shape in a nozzle plate.

FIG. 5 is a list of steps to produce a nozzle plate.

FIG. 6 is a perspective view of a liquid discharge head according to the present invention.

FIG. 7 is a cross-sectional illustration taken along line A-A of FIG. 6 to show a direction (longitudinal direction of a liquid chamber) orthogonal to a nozzle arrangement direction.

FIG. 8 is a cross-sectional illustration taken along line B-B of FIG. 6 to show the nozzle arrangement direction (lateral direction of a liquid chamber).

FIG. 9 is an illustration of a relationship between a nozzle hole shape of a nozzle plate and a meniscus position of pure water in Examples 1-3 and Comparative Example 1.

FIG. 10 is an illustration of a method for measuring a meniscus position of pure water.

FIG. 11 is a graph illustrating a film thickness of a liquid-repellent film.

FIG. 12A is a graph illustrating unevenness of boundaries of a straight part and a tapered shape part among a plurality of nozzles formed in a nozzle plate.

FIG. 12B is a graph illustrating unevenness of meniscus positions among a plurality of nozzles formed in a nozzle plate.

FIG. 13 is an enlarged cross-sectional illustration of one nozzle in a nozzle plate according to a second embodiment of the present invention.

FIG. 14 is a plan view of a nozzle plate according to a third embodiment of the present invention.

FIG. 15 is an enlarged cross-sectional illustration taken along line C-C of FIG. 14.

FIG. 16 is a plan view of a nozzle base member of a nozzle plate.

FIG. 17 is an enlarged cross-sectional illustration taken along line D-D of FIG. 16.

FIG. 18 is a plan view illustrating an area where a concavity is formed in a nozzle base member.

FIG. 19 is a plan view illustrating main elements of an apparatus for discharging liquid according to embodiments of the present invention.

FIG. 20 is a side view illustrating main elements of an apparatus for discharging liquid.

FIG. 21 is a plan view illustrating main elements of another liquid discharge device according to embodiments of the present invention.

FIG. 22 is a front view illustrating yet another liquid discharge device according to embodiments of the present invention.

DESCRIPTION OF EMBODIMENTS

In the following, embodiments of the present invention are described with reference to the attached drawings. A first embodiment of a nozzle plate according to the present invention is described with reference to FIG. 1 and FIG. 2. FIG. 1 is a cross-sectional illustration of a nozzle plate according to the first embodiment of present invention and FIG. 2 is an enlarged cross-sectional illustration of one nozzle in the nozzle plate.

A nozzle plate 1 includes a nozzle base member 40 where a plurality of nozzle holes 41 to serve as nozzles 4 for discharging droplets are formed. On a droplet discharge surface 40*a* of the nozzle base member 40, a liquid-repellent film 42 is formed.

The nozzle hole 41 includes a straight part 43 which is a straight hole part extending from the droplet discharge surface 40*a* of the nozzle base member 40 and having a constant diameter. The nozzle hole 41 also includes a tapered part 44 formed to have a tapered shape from a liquid chamber surface 40*b* (an opposite side of the droplet discharge surface) of the nozzle base member 40 to a boundary 41*b* at an end of the straight part 43 in a direction opposite to a droplet discharge direction of the straight part 43.

The liquid-repellent film 42 is formed on the droplet discharge surface 40*a* of the nozzle base member 40 within a thickness range from 5 to 30 nm by using a liquid-repellent material which is a chemical compound having a perfluoropolyether (PFPE) skeleton in its molecules.

In the following, an invasion of the nozzle hole by the liquid-repellent groups of the liquid-repellent material and regulation of invasion positions are described with reference to FIG. 3. FIG. 3 is a diagram illustrating the invasion and the regulation.

It is assumed here that a central axis 46 of the nozzle hole 41 is inclined by $\alpha°$ (including $\alpha=0$ without inclination) relative to a direction perpendicular to the droplet discharge surface 40*a*.

Even in a case where the liquid-repellent film 42 is formed only on the droplet discharge surface 40*a*, if a liquid-repellent material has flowability as in a chemical compound having a PFPE skeleton in its molecules, the liquid-repellent material or liquid-repellent groups contained in the liquid-repellent material, namely, fluorine atoms 42*a* in the present embodiment, invade the nozzle hole 41 and adhere to a inner nozzle wall 41*a* with the passage of time. Accordingly, the inner nozzle wall 41*a* is also provided with liquid repellency. In addition, it is assumed that the inner nozzle wall 41*a* is a wall configured with a wall portion 43*a* of the straight part 43 and a wall portion 44*a* of the tapered part 44.

In the present embodiment, the nozzle hole 41 includes the straight part 43 which is a straight hole extending from the droplet discharge surface 40*a* and having a constant diameter. The liquid-repellent groups (fluorine atoms 42*a* in this case) contained in the liquid-repellent film 42 adhere to the inner nozzle wall 41*a* including the straight part 43 of the nozzle hole 41. When the nozzle is supplied with pure water, a meniscus of the pure water stays in the straight part 43.

For example, in the present embodiment, a region where a static contact angle $\theta$ with the pure water is 90° or more is regulated on the inner nozzle wall 41*a* such that the region only exists on the wall portion 43*a* of the straight part 43 (straight hole) and does not exist on a part other than the straight part 43:

Specifically, the region where the static contact angle $\theta$ with the pure water is 90° or more exists on the wall portion 43*a* of the straight part 43 and does not exist from the boundary 41*b* between the straight part 43 and the tapered part 44 to the wall portion 44*a* of the tapered part 44.

In other words, in the nozzle plate 1 according to the present embodiment, a liquid-repellent material that forms the liquid-repellent film 42 is a chemical compound having a perfluoropolyether (PFPE) skeleton in its molecules.

When the nozzle hole 41 is supplied with pure water, if a length of the straight part 43 of the nozzle hole 41 is L (μm), a diameter of the straight part 43 of the nozzle hole 41 is D (μm), a distance from the droplet discharge surface 40*a* to a liquid level of the pure water within the nozzle hole 41 is X (μm), and an angle formed between the central axis 46 of the straight part 43 and a direction perpendicular relative to the droplet discharge surface 40*a* is $\alpha(°)$ where $\alpha(°)$ includes 0° and is less than 90°, the following formula (1) is established.

[Math.1]

$$L\cdot\cos\alpha-(D\cdot\tan\alpha)/2>X\cdot\cos\alpha \quad (1)$$

This formula (1) shows that even if the central axis 46 of the straight part 43 is inclined relative to the droplet discharge surface 40*a* (by $\alpha°$), a meniscus position (liquid level position) of the pure water is regulated within the straight part 43.

In this manner, liquid-repellent groups contained in the liquid-repellent film adhere to the inner nozzle wall 41*a* including the straight part 43 of the nozzle hole 41. When the nozzle is supplied with pure water, the meniscus of the pure water stays in the straight part 43. Accordingly, the meniscus of a liquid such as ink formed in the nozzle 4 is maintained in a region of the straight part 43. Even if the liquid-repellent groups 42*a* invade the inner nozzle wall 41*a*, unevenness of droplet discharge characteristics is reduced.

In other words, since a liquid (such as ink) other than pure water is more likely to move toward the droplet discharge surface 40*a* within the nozzle hole 41, when the meniscus of the pure water when the nozzle is supplied with the pure water stays in the straight part 43, the meniscus position of the liquid to be discharged is surely maintained in the region of the straight part 43.

If a region where a static contact angle $\theta$ with the pure water is 90° or more is controlled on the inner nozzle wall 41*a* such that the region only exists on the wall portion 43*a* of the straight part 43 (straight hole) and does not exist on a wall portion other than the straight part 43 (straight hole), a boundary between a region where the static contact angle $\theta$ is 90° or more and a region that does not have such a static contact angle is positioned in the straight part 43. In accordance with this, when the nozzle is supplied with the pure water, the meniscus of the pure water surely stays in the straight part 43. However, even if the static contact angle $\theta$ is less than 90°, such a static contact angle $\theta$ is included in the present invention as long as the meniscus of the pure water stays in the straight part 43.

In accordance with the above-mentioned configuration, even if a pressure chamber in communication with the nozzle hole 41 has a fluctuation of pressure so that the pressure chamber has a negative pressure, the meniscus position of the liquid to be discharged does not move to the tapered part 44. Accordingly, curved droplet discharge is reduced.

In the following, how to measure the length L (μm), the diameter D (μm), the distance X (μm), and the angle α(°) is described.

Length L: the nozzle base member 40 embedded in resin is subjected to polishing until a central section of the nozzle hole 41 comes out and the length is measured through microscopic observation using SEM, for example. For such resin, room-temperature setting epoxy resin may be used.

Diameter D: the nozzle hole 41 is observed with a metallurgical microscope from the discharge surface to measure the diameter of an outlet of the nozzle hole 41.

Distance X: the distance (μm) from a surface (droplet discharge surface 40*a*) of the nozzle base member 40 to the pure water in the inner nozzle wall 41*a* is represented.

Angle α: After the polishing, the angle α of inclination of the central axis 46 of the nozzle hole 41 is determined by obtaining a difference between a center of an outlet circle of the nozzle hole 41 on the droplet discharge surface 40*a* and a center of an outlet circle on the liquid chamber surface 40*b* through observation with a confocal microscope and by dividing the obtained difference by a thickness of the nozzle plate 1.

Next, a specific example of the nozzle plate 1 is described with reference to FIG. 4. FIG. 4 is a diagram illustrating another nozzle hole shape in the nozzle plate 1.

The shape of the nozzle hole 41 in the nozzle plate 1 is not limited to the shape as in FIG. 2 but may have a shape where a chamfered part 45 is formed as shown in FIG. 4. If the chamfered part 45 has a chamfered width 45*a* and a chamfered height 45*b*, a chamfered amount can be expressed by: the chamfered width x the chamfered height/2. Preferably, the chamfered amount is small.

While stainless steel can be used for the nozzle base member 40, a material for the nozzle base member 40 is not limited to stainless steel. It is possible to use Al, Bi, Cr, InSn, ITO, Nb, $Nb_2O_5$, NiCr, Si, $SiO_2$, Sn, $Ta_2O_5$, Ti, W, ZAO ($ZnO+Al_2O_3$), Zn, and a film thereof formed on another base member.

The liquid-repellent film 42 is a film (layer) including a chemical compound having a perfluoropolyether (PFPE) skeleton in its molecules as mentioned above.

For perfluoropolyether, known materials can be used and such materials are not limited in particular. Examples of such materials include krytoxFSL (manufactured by DuPont Co.), krytoxFSH (manufactured by DuPont Co.), FomblinZ (manufactured by Solvay Solexis Co.), FLUOROLINKS10 (manufactured by Solvay Solexis Co.), FLU-OROLINKC10 (manufactured by Solvay Solexis Co.), MORESCO PHOSFAROL A20H (manufactured by Matsumura Oil Research Co.), MORESCO PHOSFAROL ADOH (manufactured by Matsumura Oil Research Co.), MORESCO PHOSFAROL DDOH (manufactured by Matsumura Oil Research Co.), Fluoro Surf FG5010 (manufactured by FLUORO TECHNOLOGY Co.), Fluoro Surf FG5020 (manufactured by FLUORO TECHNOLOGY Co.), Fluoro Surf FG5060 (manufactured by FLUORO TECHNOLOGY Co.), and Fluoro Surf FG5070 (manufactured by FLUORO TECHNOLOGY Co.).

An average film thickness of the liquid-repellent film 42 (an average film thickness on the discharge surface of the nozzle plate 1) is preferably 5-30 nm. If the average film thickness is equal to 5 nm or more, the liquid-repellent film 42 is less likely to have a defect. If the average film thickness is equal to 30 nm or less, it is not likely that a place that has become partially thick falls off by wiping and becomes impurities. Further, by having this film thickness, it is preferable that an amount of the liquid-repellent material that flows into the inner nozzle wall 41*a* is suitably maintained, the liquid-repellent material forming the liquid-repellent film 42.

In the following, steps of producing the nozzle plate 1 are described with reference to FIG. 5. FIG. 5 is a list of steps to produce the nozzle plate 1.

The steps include an upstream step, a pretreatment step, a step of forming a liquid-repellent film, a post-treatment step, and a downstream step. While a stainless plate is used for the nozzle base member 40 in the following example, a material of the nozzle base member 40 is not limited to the stainless plate.

—Upstream Step—

The upstream step is for polishing a surface of the nozzle base member 40, namely, the discharge surface that discharges droplets.

A method for polishing the surface of the nozzle base member 40 (droplet discharge surface 40*a*) where nozzle holes 41 are formed may use a polyurethane pad to polish the surface of the nozzle base member 40 in an ultra-precision oscillating type single-side polishing machine (CMP polisher). When polishing is performed, the polyurethane pad is preferably rotated at 1-20 rpm and the surface of the nozzle base member 40 is polished until a surface roughness Ra of the surface of the nozzle base member 40 becomes 0.1 μm or less.

The surface roughness Ra of the discharge surface of the nozzle base member 40 can be obtained as follows, for example. It is possible to measure the surface roughness Ra using a probe-type surface shape measuring device Dektak-150 (manufactured by ULVAC Co.), for example, in accordance with JIS 0601.

It is possible to adjust the surface roughness Ra by changing pressure applied when the polyurethane pad presses the surface of the nozzle base member 40, a rotational speed (rpm: revolutions per minute) when the polyurethane pad is rotated, a flow of a polishing solution, and a polishing time, for example.

—Pretreatment Step—

The pretreatment step is for treating the nozzle base member 40 whose surface has been polished. In the pretreatment step, ultrasonic cleaning is performed. Other than the ultrasonic cleaning, it is also possible to perform wet cleaning such as scrub cleaning, shower cleaning (high-pressure spray cleaning, ultrasonic shower cleaning), soak cleaning (flowing water cleaning, jet cleaning, bubbling cleaning), and steam cleaning.

The nozzle base member 40 after the polishing is subjected to the ultrasonic cleaning with an organic solvent under a wet environment so as not to dry the polished surface. Preferably, the wet environment has humidity of 50% or more to avoid drying.

Examples of the organic solvent include alcohol such as acetone, ethanol, and iso-propanol, and hydrofluoroether such as Novec (manufactured by Sumitomo 3M Co.), Vertrel, (manufactured by DuPont Co.), and Galden (manufactured by Solvay Solexis Co.).

—Liquid-Repellent Film Formation Step—

In the following, a step of forming the liquid-repellent film 42 is described.

First, a dipping liquid having PFPE to form the liquid-repellent film 42 is prepared.

The surface of the nozzle base member 40 after the pretreatment, namely, the droplet discharge surface is subjected to a plasma process. Other than the plasma process, it is also possible to perform dry cleaning such as vacuum cleaning (ion-beam cleaning) and normal pressure cleaning (UV ozone cleaning, ice scrubber cleaning, laser cleaning).

Then the dipping liquid that has been prepared is applied to the nozzle base member 40 in accordance with a dipping method. After the nozzle base member 40 is allowed to stand at room temperature (about 25° C.), the nozzle base member 40 is heated and subjected to ultrasonic cleaning to remove surplus perfluoropolyether. It is preferable that when the ultrasonic cleaning is performed, surplus PFPE is removed and a film thickness of the liquid-repellent film 42 is adjusted at a monomolecular layer level.

For the dipping liquid that forms the liquid-repellent film 42, it is possible to use a perfluoropolyether derivative diluted with a fluorine solvent to achieve 1% by weight or less. Preferably, the perfluoropolyether derivative has a polar group at an end thereof. Examples of such a polar group here include —OH, C═O, —COOH, —$NH_2$, —$NO_2$, —$NH_3^+$, and —CN.

Examples of the fluorine solvent include hydrofluoroether such as Novec (manufactured by Sumitomo 3M Co.), Vertrel, (manufactured by DuPont Co.), and Galden (manufactured by Solvay Solexis Co.)

Further, the discharge surface of the nozzle base member 40 is subjected to an oxygen plasma process.

In accordance with the above-mentioned method for forming the liquid-repellent film 42, the nozzle base member 40 is immersed in the dipping liquid and raised. Then the nozzle base member 40 is allowed to experience air drying in a room temperature environment and the nozzle base member 40 is heated to fix the liquid-repellent film 42. However, a heating temperature and a heating time can be changed depending on a purpose.

Further, it is possible to remove perfluoropolyether excessively attached to the discharge surface of the nozzle base member 40 by performing the ultrasonic cleaning in the fluorine solvent.

—Post-Treatment Step—

In the following, the post-treatment step is described. In order to protect a surface of the liquid-repellent film 42, the discharge surface is covered with a laminate material (laminated) and a back surface of the nozzle base member 40, namely, an opposite side of the discharge surface is subjected to a plasma process.

In the nozzle plate 1 obtained as mentioned above, a liquid-repellent material attached to the liquid chamber surface 40*b* the inner nozzle wall 41*a* is removed when the nozzle plate 1 is irradiated with oxygen plasma for reverse sputtering while a nozzle surface is protected.

Even if the liquid-repellent material attached to the inner nozzle wall 41*a* is removed in this manner, the liquid-repellent groups 42*a* invade the inner nozzle wall 41*a* and adhere to it with the passage of time due to flowability of the liquid-repellent material as mentioned above.

—Downstream Step—

The downstream step is performed where necessary. The downstream step is for bonding the nozzle plate 1 to a member that constitutes a liquid chamber and re-inforcing bonding strength through heating.

When the bonding is performed in the downstream step, the nozzle plate 1 obtained in the above-mentioned post-treatment step is bonded to a channel plate using a cold-setting epoxy adhesive, for example. Preferably, the bonding is performed through heating and pressing in order to maintain a bonded state for a long term.

Examples of the adhesive to be used include a cold-setting epoxy adhesive.

In the following, a liquid discharge head according to the present invention is described with reference to FIGS. 6-8. FIG. 6 is a perspective view of the liquid discharge head. FIG. 7 is a cross-sectional illustration taken along line A-A of FIG. 6 to show a direction (longitudinal direction of the liquid chamber) orthogonal to a nozzle arrangement direction. FIG. 8 is a cross-sectional illustration taken along line B-B of FIG. 6 to show the nozzle arrangement direction (lateral direction of the liquid chamber).

The liquid discharge head includes the nozzle plate 1, a channel plate 2, and a vibration plate member 3 that serves as a wall member in a laminated and joined manner. The liquid discharge head further includes a piezoelectric actuator 11 that displaces the vibration plate member 3 and a frame member 20 that serves as a common channel member.

The nozzle plate 1, the channel plate 2, and the vibration plate member 3 constitute an individual channel 5 in communication with a nozzle 4 that discharges droplets. The individual channel 5 includes, from the nozzle 4 disposed downstream, an individual liquid chamber 6 in communication with the nozzle 4 disposed downstream, a fluid resistance part 7 that supplies the individual liquid chamber 6 with liquid, and a liquid introduction part 8 in communication with the fluid resistance part 7.

A liquid is introduced into the individual channel 5 through an introduction part (supply port) 9 formed on the vibration plate member 3 from a common liquid chamber 10 that serves as a common channel of the frame member 20. The liquid is provided to the individual liquid chamber 6 through the liquid introduction part 8 and the fluid resistance part 7. Further, a filter may be disposed on the introduction part 9.

It is assumed here that the nozzle plate 1 is the above-mentioned nozzle plate according to embodiments of the present invention and a liquid-repellent film is formed on the droplet discharge surface thereof.

The channel plate 2 is prepared by etching a SUS substrate. The channel plate 2 serves as a through part that forms the individual channel 5 including such as the individual liquid chamber 6, the fluid resistance part 7, and the liquid introduction part 8.

The vibration plate member 3 is a wall member that forms a wall of the individual liquid chamber 6 of the channel plate 2. The vibration plate member 3 has a three-layer structure, in which a first layer is disposed on the channel plate 2 and forms a deformable vibration region (vibration plate) 30 in a part for the individual liquid chamber 6.

The vibration plate member 3 is formed from a nickel (Ni) metal plate and is manufactured in an electroforming method. The vibration plate member 3 is not limited to this but may use another metal member, resin member, or laminated member having a resin layer and a metal layer.

The piezoelectric actuator 11 is disposed on an opposite side of the individual liquid chamber 6 relative to the vibration plate member 3. The piezoelectric actuator 11 includes an electrochemical transducer as a driving unit (actuator unit, pressure generation unit) that deforms the vibration region 30 of the vibration plate member 3.

The piezoelectric actuator 11 includes a base member 13 and a piezoelectric member 12 having a plurality of layers joined thereon using an adhesive. Grooving is applied to the piezoelectric member 12 using half-cut dicing such that a predetermined number of piezoelectric columns 12A and 12B are formed at predetermined intervals to have a comb-like shape for one piezoelectric member 12.

While the piezoelectric columns 12A and 12B of the piezoelectric member 12 have the same configuration, the piezoelectric columns 12A and 12B are differentiated such that those piezoelectric columns provided with a driving waveform for driving are referred to as driven piezoelectric columns (driven columns) 12A and those piezoelectric columns provided with no driving waveform and used simply as supports are referred to as non-driven piezoelectric columns (non-driven columns) 12B.

The driven column 12A is joined to a convex part 30*a* that serves as an insular thick part formed on the vibration region 30 of the vibration plate member 3. Further, the non-driven column 12B is joined to a convex part 30*b* that serves as a thick part of the vibration plate member 3.

The piezoelectric member 12 alternately has a piezoelectric layer and an inner electrode in a laminated manner. The inner electrodes are drawn out to end surfaces thereof where external electrodes are disposed. An FPC 15 that serves as a flexible wiring board and has flexibility to provide a driving signal is connected to the external electrodes of the piezoelectric columns 12A.

The frame member 20 is formed using epoxy resin or polyphenylene sulfide which is thermoplastic resin through injection molding, for example. The frame member 20 forms the common liquid chamber 10 to which a liquid is provided from a head tank or a liquid cartridge (not shown).

In the liquid discharge head configured in this manner, if voltage applied to the piezoelectric column 12A is lowered from a reference potential, the piezoelectric column 12A contracts, and the vibration region 30 of the vibration plate member 3 ascends to expand capacity of the individual liquid chamber 6, so that the liquid flows into the individual liquid chamber 6.

Then the voltage applied to the piezoelectric column 12A is raised to expand the piezoelectric column 12A in a lamination direction thereof and deforms the vibration region 30 of the vibration plate member 3 toward the nozzle 4 to contract the capacity of the individual liquid chamber 6, so that the liquid in the individual liquid chamber 6 is pressurized and a droplet is discharged (injected) from the nozzle 4.

When the voltage applied to the piezoelectric column 12A is returned to the reference potential, the vibration region 30 of the vibration plate member 3 restores an initial position and the individual liquid chamber 6 expands to cause negative pressure, so that the individual liquid chamber 6 is supplied with the liquid from the common liquid chamber 10. After a vibration of a meniscus surface of the nozzle 4 is attenuated and the meniscus is stabilized, the process proceeds to an operation to discharge a next droplet.

In addition, a method for driving the liquid discharge head is not limited to the above-mentioned example (pull-push injection). It is possible to perform pull-injection or push-injection by controlling a driving waveform to be applied.

Since the liquid discharge head includes the nozzle plate according to embodiments of the present invention in this manner, the liquid discharge head can perform stable droplet discharge with reduced unevenness of droplet discharge characteristics.

In the following, ink is described as an example of a liquid discharged by the liquid discharge head according to embodiments of the present invention.

Components of ink include a color material, a wetting agent, a water-soluble organic solvent, a surface active agent, other additive agents (such as pH adjuster, an antiseptic mildew-proofing agent, an antirust agent, a water-soluble ultraviolet absorber, a water-soluble infrared absorber), and resin, for example.

—Color Material—

For the color material, it is possible to use known pigments and dyes where necessary. For example, inorganic pigments and organic pigments can be used.

Examples of the inorganic pigments include titanic oxide, iron oxide, calcium carbonate, barium sulfate, aluminum hydroxide, barium yellow, cadmium red, chrome yellow, and carbon black prepared in a known method such as a contact method, a furnace method, or a thermal method.

Examples of the organic pigments include azo pigments (including azo lakes, insoluble azo pigments, condensed azo pigments, and chelate azo pigments), polycyclic pigments (such as phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (such as basic dye chelates and acid dye chelates), nitro pigments, nitroso pigments, and aniline black.

In particular, from the above-mentioned pigments, those having an affinity to a solvent are preferably used.

In addition to the above-mentioned examples, it is possible to use self-dispersing pigments in which functional groups such as sulfone groups or carboxyl groups are added to a surface of a pigment (such as carbon) to be dispersible in water. Further, pigments may be contained in microcapsules to be dispersible in water.

Preferably, an adding amount of pigments as a color material in ink is 0.5-25% by weight, and more preferably 2-15% by weight.

—Water-Soluble Organic Solvent—

Examples of the water-soluble organic solvent include polyhydric alcohol such as ethylene glycol, diethylene glycol, triethylene glycol, polyethylene glycol, polypropylene glycol, 1,5-pentanediol, 1,6-hexanediol, glycerin, 1,2,6-hexanetriol, 1,2,4-butanetriol, 1,2,3-butanetriol, and 3-methylpentane-1,3,5-triol; polyhydric alcohol alkyl ether such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monomethyl ether; polyhydric alcohol aryl ether such as ethylene glycol monophenyl ether and ethylene glycol monobenzyl ether; nitrogen-containing heterocyclic compounds such as N-methyl-2-pyrrolidone, N-hydroxyethyl-2-pyrrolidone, 2-pyrrolidone, 1,3-dimethyl imidazolidinone, and ε-caprolactam; amides such as formamide, N-methyl formamide, and N,N-dimethylformamide; amines such as monoethanolamine, diethanolamine, triethanolamine, monoethylamine, diethylamine, and triethylamine; sulfur-containing compounds such as dimethyl sulfoxide, sulfolane, and thiodiethanol; propylene carbonate; ethylene carbonate; and γ-butyrolactone.

—Surface Active Agent—

The surface active agent is added where necessary in order to improve performance of cleaning, stability of mixture of a supplied liquid functioning as a cleaning liquid, and resupply performance after cleaning, for example.

Examples of the surface active agent include fluorine surface active agents, anionic surface active agents, cationic surface active agents, nonionic surface active agents, and amphoteric surface active agents.

Examples of the fluorine surface active agents include perfluoroalkyl sulfonate, perfluoroalkyl carboxylate, perfluoroalkyl phosphate ester, perfluoroalkyl ethylene oxide adducts, perfluoroalkyl betaine, perfluoroalkyl amine oxide compounds, polyoxyalkylene ether polymers having a perfluoroalkylether group in a side chain, sulfuric acid ester salts thereof, and fluoroaliphatic polymer ester.

Examples of the fluorine surface active agents that are commercially available include Surflon S-111, S-112, S-113, S121, S131, S132, S-141, S-145 (manufactured by ASAHI GLASS Co.).

Examples of the anionic surface active agents include alkyl aryl or alkyl naphthalene sulfonate, alkyl phosphate, alkyl sulfate, alkyl sulfonate, alkyl ether sulfate, alkyl sulfosuccinate, alkyl ester sulfate, alkyl benzene sulfonate, alkyl diphenyl ether disulfonate, alkyl aryl ether phosphate, alkyl aryl ether sulfate, alkyl aryl ether ester sulfate, olefin sulfonate, alkane olefin sulfonate, polyoxyethylene alkyl ether phosphate, polyoxyethylene alkyl ether sulfuric ester salt, ether carboxylate, sulfosuccinate, α-sulfoalicyclic acid ester, aliphatic acid salt, condensation products of a higher aliphatic acid and an amino acid, and naphthenate.

Examples of the cationic surface active agents include alkyl amine salt, dialkyl amine salt, aliphatic amine salt, benzalkonium salt, quaternary amonium salt, alkyl pyridinium salt, imidazolinium salt, sulfonium salt, and phosphonium salt.

Examples of the nonionic surface active agents include polyoxyethylene alkyl ether, polyoxyethylene alkylallyl ether, polyoxyethylene alkyl phenyl ether, polyoxyethylene glycol ester, polyoxyethylene fatty acid amide, polyoxyethylene fatty acid ester, polyoxyethylene polyoxypropylene glycol, glycerin ester, sorbitan ester, sucrose ester, polyoxyethylene ether of glycerin ester, polyoxyethylene ether of sorbitan ester, polyoxyethylene ether of sorbitol ester, fatty acid alkanolamide, amine oxide, polyoxyethylene alkylamine, glycerine fatty acid ester, sorbitan fatty acid ester, polyoxyethylene sorbitan fatty acid ester, polyoxyethylene sorbitol fatty acid ester, and alkyl (poly) glycoside.

Examples of the amphoteric surface active agents include imidazoline derivatives such as imidazolinium betaine, dimethyl alkyl lauryl betaine, alkyl glycine, and alkyl di(aminoethyl) glycine.

—Other Additive Agents—

Other additive agents include pH adjusters and antiseptic mildew-proofing agents, for example.

Examples of the pH adjusters include hydroxides of alkaline metal elements such as lithium hydroxide, sodium hydroxide, and potassium hydroxide; carbonates of alkaline metals such as lithium carbonate, sodium carbonate, and potassium carbonate; amines such as quaternary ammonium hydroxide, diethanolamine, and triethanolamine; ammonium hydroxide; and quaternary phosphonium hydroxide.

Examples of the antiseptic mildew-proofing agents include 1,2-benzisothiazolin-3-one, sodium benzoate, sodium dehydroacetate, sodium sorbate, sodium pentachlorophenol, and sodium 2-pyridinethiol-1-oxide.

—Resin—

Resin is added where necessary in order to improve image fixation, image quality, and pigment dispersing quality. Examples of the resin include the following hydrophilic polymers. Natural hydrophilic polymers include vegetable polymers such as gum arabic, tragacanth gum, guar gum, karaya gum, locust bean gum, arabinogalactan, pectin, and quince seed starch; seaweed polymers such as alginic acid, carrageenan, and agar; animal polymers such as gelatin, casein, albumin, and collagen; microbial polymers such as xanthan gum and dextran. Semi-synthetic hydrophilic polymers include cellulose polymers such as methylcellulose, ethylcellulose, hydroxyethylcellulose, hydroxypropylcellulose, and carboxymethylcellulose; starch polymers such as sodium starch glycolate, and sodium starch phosphate ester; and seaweed polymers such as sodium alginate, and propylene glycol alginate ester. Pure synthetic hydrophilic polymers include polyacrylic acid, polymethacrylic acid, acrylic acid-acrylonitrile copolymer, vinyl acetate-acrylic acid ester copolymer, acrylic acid-acrylic acid alkyl ester copolymer, styrene-acrylic acid copolymer, styrene-methacrylic acid copolymer, styrene-acrylic acid-acrylic acid alkyl ester copolymer, styrene-methacrylic acid-acrylic acid alkyl ester copolymer, styrene-α-methylstyrene-acrylic acid copolymer, acrylic acid alkyl ester copolymer, styrene-maleic acid copolymer, vinyl-naphthalene-maleic acid copolymer, vinyl acetate-ethylene copolymer, vinyl acetate-fatty acid vinyl ethylene copolymer, vinyl acetate-maleic ester copolymer, vinyl acetate-crotonic acid copolymer, vinyl acetate-acrylic acid copolymer, and salts thereof. An adding amount of these types of resin is determined where necessary in consideration of reliability thereof.

Further, in recent years, instead of resin that is to be dissolved in a solvent, what is called resin emulsion in which fine particles are dispersed in a solvent is used in many cases. In the resin emulsion, resin fine particles are dispersed in the solvent as a continuous phase. A dispersing agent such as a surface active agent may be included in the resin emulsion where necessary.

Content of the resin fine particles as components of a dispersed phase (content of the resin fine particles in the resin emulsion) generally ranges 10-70% by weight. An average particle size of the resin fine particles is preferably 10-1000 nm in consideration of application to an ink-jet recording apparatus and is more preferably 20-300 nm. However, the average particle size of the resin fine particles is not limited in particular.

Examples of components of the resin fine particles in the dispersed phase include acrylic resin, vinyl acetate resin, styrene resin, butadiene resin, styrene-butadiene resin, vinyl chloride resin, acrylic styrene resin, and acrylic silicon resin. While the acrylic silicon resin is especially effective, a type of the resin fine particles is not limited in particular. The components of the resin fine particles are for ensuring reliability when known one is used. It is possible to use commercially available resin emulsion.

A content of the resin fine particles in ink is generally 0.1-50% by weight, preferably 0.5-20% by weight, more preferably 1-10%. However, the content of the resin fine particles in ink is not limited in particular.

—Static Surface Tension—

Ink used in embodiments of the present invention preferably includes the above-mentioned fluorine surface active agent and has a static surface tension of $30\times10^{-2}$ N/m or less. When the ink having the static surface tension of $30\times10^{-2}$ N/m or less is prepared, it is possible to adjust the static surface tension using an amount of a penetrating agent such as 2-ethyl-1,3-hexanediol, and an adding amount of the fluorine surface active agent. If the static surface tension is $30\times10^{-2}$ N/m or less, it is possible to improve permeability of ink for a recording medium and obtain a high-quality image.

A value of the surface tension can be obtained using the Zisman method, for example. According to this method, a liquid whose surface tension is known is dropped onto the liquid-repellent film 42, a contact angle θ is measured, and surface tensions of the liquid are plotted on an x axis and cos θ is plotted on a y axis to obtain a straight line on the decline in the right (called a Zisman Plot). According to the straight line, it is possible to calculate a surface tension where y=1(θ=0°) as a critical surface tension γc.

Other than the above-mentioned method, it is also possible to obtain a value of critical surface tension using the Fowkes method, the Owens and Wendt method, or the Van Oss method.

In the following, specific examples of the present invention will be described with a comparative example.

Examples 1-3, Comparative Example 1

A surface of the discharge surface of the stainless nozzle base member 40 where nozzle holes 41 having a diameter of 25 μm are formed was polished.

The polishing was performed using an ultra-precision oscillating type single-side polishing machine (CMP polisher manufactured by EBARA Co.) while a polyurethane pad was pressed with a polishing pressure of 10 kPa. When the polishing was performed, POLIPLA103 (manufactured by FUJIMI Co.) which is a liquid in which alumina polishing powder is dispersed was diluted with 4 times of pure water (volume ratio, POLIPLA103:pure water=1:3) and was applied to a part being polished while the stainless nozzle plate was rotated at a rotational speed of 50 rpm.

In this case, the surface of the discharge surface was confirmed to be polished until a surface roughness Ra of the discharge surface became 0.1 μm or less. The surface roughness Ra was measured using a probe-type surface shape measuring device Dektak-150 (manufactured by ULVAC Co.) in accordance with JIS 0601.

A length of the straight part 43 within the nozzle hole 41 was controlled by adjusting a polishing time and pressure. Table 1 shows the polishing time and the pressure.

TABLE 1

| | EXAMPLE 1 | EXAMPLE 2 | EXAMPLE 3 | COMPARATIVE EXAMPLE 1 |
|---|---|---|---|---|
| POLISHING TIME (MINUTE) | 3 | 6 | 10 | 20 |
| PRESSURE (KILOGRAM-WEIGHT) | 10 | 5 | 10 | 5 |
| STRAIGHT PART LENGTH L (μm) | 8.00 | 8.00 | 3.00 | 3.00 |

Next, the discharge surface of the stainless nozzle base member 40 was subjected to an oxygen plasma process using a plasma processing device PDC-510 manufactured by Yamato Scientific Co. with 500 W and 0.0012 g/s for one minute.

Next, Fluoro Surf FG5020 (manufactured by FLUORO TECHNOLOGY Co.) was used as perfluoropolyether and was diluted with a fluorine solvent (Novec HFE7100 manufactured by Sumitomo 3M Co.) to achieve 0.2% by weight. This was applied, as a dipping liquid, to the discharge surface of the nozzle base member 40.

In the application, the nozzle base member 40 was immersed in the solution and was withdrawn at a withdrawing speed of 3 mm/s.

As shown in Table 2, perfluoropolyether liquid-repellent films 42 having different film qualities were formed into Examples 1-3 and Comparative Example 1 by changing a plasma processing time and the withdrawing speed.

TABLE 2

| | EXAMPLE 1 | EXAMPLE 2 | EXAMPLE 3 | COMPARATIVE EXAMPLE 1 |
|---|---|---|---|---|
| HEATING TEMPERATURE (° C.) | 120 | 120 | 120 | 120 |
| PLASMA PROCESS TIME (MINUTE) | 0.5 | 0.1 | 1 | 0.2 |
| WITHDRAWING SPEED (mm/s) | 1 | 5 | 7 | 10 |
| X (μm) | 0.40 | 6.00 | 0.40 | 6.00 |

A film thickness of the liquid-repellent film 42 was 12 nm.

After the film formation, ultrasonic cleaning was performed for five minutes using a solvent of Novec HFE7100 (manufactured by Sumitomo 3M Co.).

The nozzle surface (discharge surface) of the nozzle base member 40 on which the liquid-repellent film 42 was formed in this manner was protected with ICROS TAPE (Mitsui Chemicals Co.). Then the nozzle base member 40 was irradiated with oxygen plasma (0.0012 g/s for one minute) using the plasma processing device PDC-510 (manufactured by Yamato Scientific Co.) for reverse sputtering, thereby removing the liquid-repellent film 42 attached to the liquid chamber surface and the inner nozzle wall 41*a* of the nozzle hole 41.

Next, the nozzle base member 40 and the channel plate 2 were heated at 70° C. while being pressed against each other for five hours to be bonded via a cold-setting epoxy adhesive. The cold-setting epoxy adhesive used here was AE-901 series (manufactured by Ajinomoto Fine-Techno Co.) which does not set at room temperature but starts setting at 60-100° C.

A distance X (μm) from a surface (discharge surface) of the nozzle plate 1 to a meniscus of pure water in the inner nozzle wall 41*a* was adjusted using the plasma processing time and the withdrawing speed from the dipping liquid. The processing time, the withdrawing speed, and the distance X(μm) are shown in Table 2.

In accordance with the above-mentioned process, nozzle plates 1 of Examples 1-3 and Comparative Example 1 were prepared.

Table 3 shows results of determination of whether the nozzle plates 1 of Examples 1-3 and Comparative Example 1 satisfied the above-mentioned formula (1) and dimensions of each part in the formula (1). FIG. 9 shows a relationship between a nozzle hole shape and a meniscus position of pure water in the nozzle plates 1 of Examples 1-3 and Comparative Example 1.

TABLE 3

| | EXAMPLE 1 | EXAMPLE 2 | EXAMPLE 3 | COMPARATIVE EXAMPLE 1 |
|---|---|---|---|---|
| α (°) | 10.00 | 10.00 | 10.00 | 10.00 |
| L (μm) | 8.00 | 8.00 | 3.00 | 3.00 |
| D (μm) | 20.00 | 20.00 | 20.00 | 20.00 |
| x (μm) | 0.40 | 6.00 | 0.40 | 6.00 |
| cos | 0.98 | 0.98 | 0.98 | 0.98 |
| tan | 0.18 | 0.18 | 0.18 | 0.18 |
| $L \cdot \cos\alpha - (D \cdot \tan\alpha)/2$ | 6.12 | 6.12 | 1.19 | 1.19 |
| $X \cdot \cos\alpha$ | 0.39 | 5.91 | 0.39 | 5.91 |
| DETERMINATION OF WHETHER FORMULA (1) IS SATISFIED | ○ | ○ | ○ | x |

Meniscus positions and curved discharge amounts of the nozzle plates 1 prepared for Examples 1-3 and Comparative Example 1 were measured.

(Measurement of Meniscus Position)

FIG. 10 is an illustration of a method for measuring a meniscus position of pure water. FIG. 10-(*a*) is a diagram showing the whole part of the measuring. FIG. 10-(*b*) is an enlarged view of section E in FIG. 10-(*a*). FIG. 10-(*c*) is an enlarged view of section F in FIG. 10-(*b*).

Pure water was dropped on a slide glass using a dropper and the nozzle plate 1 was placed on the slide glass such that the pure water is brought into contact with the liquid chamber surface. When the pure water is brought into contact with the liquid chamber surface of the nozzle plate 1, the liquid chamber surface including an opening of the nozzle hole 41, a meniscus of the pure water stays in the straight part 43 of the nozzle hole 41. A water surface position rose by capillary force in the nozzle hole 41 was observed using a laser microscope and a distance from the surface of the liquid-repellent film 42 of the nozzle plate 1 to the water surface position was defined as the meniscus position of pure water.

(Measurement of Curved Discharge Amount)

Measurement of curved discharge amounts was possible using a device that measures ink-jet landing positions and a device that observes ink droplet discharge directions. The measurement was made using JetScope (manufactured by MICROJET Co.), for example. Evaluation was conducted by printing a nozzle check pattern for RICOH GX-3000, an ink-jet printer manufactured by RICOH, Co. A difference between a correct discharge position and an actual discharge position was measured as a curved discharge amount (μm).

Ink compositions used for the evaluation were as follows.

A composition prepared as follows was stirred and dissolved at 60° C., allowed to stand for cooling at room temperature, and then adjusted to have pH 9-10 using a lithium hydroxide 10% solution, and filtrated via a filter of 0.22 μm, thereby preparing Ink 1. A static surface tension of Ink 1 was 30×10-3 N/m.

| Preparation of Ink 1 | |
|---|---|
| C.I. Direct Black 168 | 3% by weight |
| 2-pyrrolidone | 3% by weight |
| diethylene glycol | 4% by weight |
| glycerin | 1% by weight |
| alkyl ether carboxylate surface active agent ECTD-3NEX (surface active agent manufactured by NIHON SURFACTANT KOGYO. K.K.) | 0.1% by weight |
| Nonipol 400 (surface active agent manufactured by Sanyo chemical industries Ltd.) | 0.5% by weight |

-continued

| Preparation of Ink 1 | |
|---|---|
| San-ai bac P-100 (antiseptic mildew-proofing agent manufactured by SAN-AI OIL Co.) | 0.4% by weight |
| ion-exchanged water | the rest |

Table 4 shows a measurement result.

TABLE 4

| | EXAMPLE 1 | EXAMPLE 2 | EXAMPLE 3 | COMPARATIVE EXAMPLE 1 |
|---|---|---|---|---|
| MENISCUS POSITION (μm) | 0.4 | 6 | 0.4 | 6 |
| CURVED DISCHARGE AMOUNT (σ) (μm) | 10.1 | 8.7 | 9.3 | 26.3 |

From this result, it was clear that Comparative Example 1 that did not satisfy the formula (1) had substantial unevenness of discharge directions in comparison with Examples 1-3 that satisfied the formula (1).

As shown in Table 4, in Examples 1-3 that satisfied the formula (1), a meniscus was always able to stay "within the straight part 43 of the nozzle hole 41". By contrast, in Comparative Example 1 that did not satisfy the formula (1), a meniscus was positioned across "the straight part 43 of the nozzle hole 41" and "the boundary between the straight part 43 and the tapered part 44". Accordingly, it is considered that an angle formed between the meniscus and the surface of the nozzle plate 1 was unstable and discharge was unstable as a result.

In the following, a film thickness of the liquid-repellent film 42 is described.

When a film thickness of the liquid-repellent film 42 including PFPE is increased, an amount of a liquid-repellent material for the liquid-repellent film 42 that flows into the nozzle hole 41 is increased. By contrast, if the film thickness of the liquid-repellent film 42 including PFPE is reduced, the liquid-repellent film 42 will be deteriorated when wiping is performed using a wiper member and performance of the liquid-repellent film 42 will be lost before a desired number of wiping is performed.

The film thickness of the liquid-repellent film 42 including PFPE was measured in accordance with FT-TR reflection absorption spectroscopy (RAS).

The film thickness was calculated based on the fact that a peak base line that appears near 1333 cm-1 of an obtained infrared absorption spectrum and a peak height of an absorption waveform are in proportion to the film thickness. As the thickness of the liquid-repellent film 42 is increased, the peak height in IR-RAS shows a higher value.

FIG. 11 is a graph showing a result of plotting where the X axis indicates the peak height in IR-RAS and the Y axis indicates a meniscus position of pure water.

In accordance with the result, the meniscus position of pure water stably rises until the peak height in IR-RAS is 0.025, but as the peak height becomes larger, nearly 0.04 in particular, the meniscus position of pure water greatly drops.

Accordingly, for the film thickness of the liquid-repellent film 42, the peak height in IR-RAS is preferably 0.025 or less.

By contrast, if the film thickness of the liquid-repellent film 42 is below 45 Fatm % in XPS, liquid repellency tends to be reduced immediately when wiping is performed. It is estimated that this is because PFPE of the liquid-repellent film 42 fails to cover the nozzle base member 40.

Accordingly, the film thickness of the liquid-repellent film 42 is preferably 45 Fatm % or more in XPS measurement.

In the following, unevenness of the boundary 41*b* between the straight part 43 and the tapered part 44 and unevenness of the meniscus position among a plurality of nozzles formed in the nozzle plate 1 are described with reference to FIGS. 12A and 12B.

A length L of the straight part 43 of the nozzle plate 1 used here has 5 (μm) as a desired value (designed value) thereof. The length L of the straight part 43 of actual nozzles was measured in comparison with this desired value (designed value). FIG. 12A is a graph showing a result of this measurement where the ordinate indicates the length of the straight part 43 and the abscissa indicates a number of nozzles (count) having the same length.

There is unevenness of an actual length L compared with the desired value of the length L of the straight part 43 in this manner and unevenness of inclination (α°) of the straight part 43.

In view of this, by positioning the meniscus of pure water in the straight part 43 when the nozzle 4 is supplied with pure water, it is possible to locate a range of the meniscuses of ink outside a range of the unevenness of the actual lengths L of the straight parts 43 relative to the desired value as shown in FIG. 12B.

In accordance with this, the meniscus position among a plurality of nozzles 4 formed in the nozzle plate 1 becomes stable and unevenness of droplet discharge characteristics is reduced.

In the following, a second embodiment of the nozzle plate 1 according to the present invention is described with reference to FIG. 13. FIG. 13 is an enlarged cross-sectional illustration of one nozzle in the nozzle plate 1 according to the second embodiment.

In the nozzle plate 1 according to the present embodiment, a base member 48 includes the nozzle base member 40 and a base film 49 formed at least on the droplet discharge surface 40*a* and the inner nozzle wall 41*a* of the nozzle base member 40.

The base film 49 is a film that increases adhesiveness between the liquid-repellent film 42 and the nozzle base member 40 (included in the base member 48). Examples of the base film 49 include a $SiO_2$ film, a Ti film, and a film containing Hf, Ta, or Zr.

In the present embodiment, the nozzle hole 41 includes the straight part 43 which is a straight hole extending from the droplet discharge surface 40*a* and having a constant diameter. Liquid-repellent groups (fluorine atoms 42*a* in this case) contained in the liquid-repellent film 42 adhere to the inner nozzle wall 41*a* including the straight part 43 of the nozzle hole 41. When the nozzle is supplied with pure water, a meniscus of the pure water stays in the straight part 43.

For example, in the present embodiment, a region where a static contact angle θ with the pure water is 90° or more is regulated on the inner nozzle wall 41*a* such that the region only exists on the wall portion 43*a* of the straight part 43 (straight hole) and does not exist on a part other than the straight part 43.

Specifically, the region where the static contact angle θ with the pure water is 90° or more exists on the wall portion 43*a* of the straight part 43 and does not exist from the boundary 41*b* between the straight part 43 and the tapered part 44 to the wall portion 44*a* of the tapered part 44.

An example of a liquid discharge head that includes the nozzle plate 1 according to the present embodiment is the same as mentioned above.

In the following, a third embodiment of the nozzle plate 1 according to the present invention is described with reference to FIGS. 14-18. FIG. 14 is a plan view of the nozzle plate 1 according to the third embodiment of the present invention. FIG. 15 is an enlarged cross-sectional illustration taken along line C-C of FIG. 14. FIG. 16 is a plan view of the nozzle base member 40 of the nozzle plate 1. FIG. 17 is an enlarged cross-sectional illustration taken along line D-D of FIG. 16. FIG. 18 is a plan view illustrating an area where concavity is formed in the nozzle base member 40.

In the present embodiment, a plurality of concavities (hereafter referred to as "dimples") 143 are formed on the droplet discharge surface 40*a* of the nozzle base member 40. Although an arrangement of the dimples 143 is simplified for ease of description in the drawings, multiple dimples 143 are formed and arranged around a nozzle line where a plurality of nozzles 4 are arranged.

A diameter of the dimple 143 is larger than the diameter of the nozzle hole 41. Preferably, a wall of the dimple 143 has a curved shape. Further, the dimples 143 are formed in a region 40*c* outside a region 40*b* around the nozzle holes 41 as shown in FIG. 18. Specifically, the dimples 143 are formed in a region located at least 150 μm from a center of the nozzle hole 41. Further, a surface roughness Ra of the nozzle base member 40 when the dimples 143 are formed is 0.1 μm or less.

The liquid-repellent film 42 is formed by applying a liquid-repellent material having flowability to the droplet discharge surface 40*a* of the nozzle base member 40, the liquid-repellent material being a chemical compound having a perfluoropolyether (PFPE) skeleton in its molecules.

In this case, the liquid-repellent material forming the liquid-repellent film 42 is held with flowability in the dimple 143.

In other words, in the dimple 143, while molecules of the liquid-repellent film 42 are bonded to the nozzle base member 40 at a boundary surface with the nozzle base member 40, molecules positioned other than at the boundary surface with the nozzle base member 40 (surface side of the liquid-repellent film 42, namely, between a surface of the liquid-repellent film 42 and the boundary surface with the nozzle base member 40) are in a free state. In addition, if the nozzle base member 40 includes the base film 49, the "boundary surface with the nozzle base member 40" means a boundary surface with the base film 49.

The dimple 143 preferably has a diameter of 80-120 μm and a depth of 2-4 μm, for example. Further, the dimple 143 preferably has a gentle inclination on an inner wall thereof.

In an apparatus for discharging liquid, the apparatus using a liquid discharge head including the nozzle plate 1 according to the present embodiment, a wiper member 422 (see FIG. 19) for wiping including an elastic member performs a wiping operation on the nozzle surface (surface of the liquid-repellent film 42 in this case) as described below in order to maintain and recover performance of the liquid discharge head.

In this case, when the wiper member 422 goes into the dimple 143, the liquid-repellent material for the liquid-repellent film 42 having flowability held in the dimple 143 is scraped off.

Accordingly, even if the liquid-repellent film 42 around the nozzles 4 becomes thinner or is removed after the wiping operation, the liquid-repellent material scraped off from the dimple 143 moves around the nozzles 4 to restore the liquid-repellent film 42.

In accordance with this, it is possible to prevent reduction of liquid repellency of the liquid-repellent film 42 accompanied by the wiping operation with the passage of time and to maintain the liquid repellency for an increased period of time.

An example of a liquid discharge head that includes the nozzle plate 1 according to the present embodiment is the same as mentioned above.

In the following, an example of an apparatus for discharging liquid according to the present invention is described with reference to FIGS. 19-20. FIG. 19 is a plan view illustrating main elements of the apparatus. FIG. 20 is a side view illustrating the main elements of the apparatus.

The apparatus is a serial type. A carriage 403 reciprocates in a main-scanning direction driven by a main-scanning movement mechanism 493. The main-scanning movement mechanism 493 includes a guide member 401, a main-scanning motor 405, a timing belt 408, and the like. The guide member 401 is installed between right and left side plates 491B and 491A and holds the carriage 403 in a movable manner. The carriage 403 is reciprocated in the main-scanning direction by the main-scanning motor 405 via the timing belt 408 stretched and installed between a driving pulley 406 and a driven pulley 407.

On the carriage 403, a liquid discharge device 440 is installed in which a liquid discharge head 404 according to the present invention including the nozzle plate 1 according to the present invention and a head tank 441 are integrated.

The liquid discharge head 404 of the liquid discharge device 440 discharges liquids of colors yellow (Y), cyan (C), magenta (M), and black (K), for example. Further, the liquid discharge head 404 has a nozzle line arranged in a sub-scanning direction orthogonal to the main-scanning direction, the nozzle line including a plurality of nozzles and being installed on the liquid discharge head 404 while its discharge is directed downward.

The head tank 441 is supplied with liquid stored in a liquid cartridge 450 by a supply mechanism 494 that supplies the liquid discharge head 404 with liquid stored outside the liquid discharge head 404.

The supply mechanism 494 includes a cartridge holder 451 serving as a supply unit that carries the liquid cartridges 450, tubes 456, a liquid sending unit 452 having a liquid sending pump, and the like. The liquid cartridges 450 are detachably installed on the cartridge holder 451. Liquid is sent to the head tank 441 from the liquid cartridges 450 by the liquid sending unit 452 via the tubes 456.

The apparatus includes a conveyance mechanism 495 to convey paper 410. The conveyance mechanism 495 includes a conveyance belt 412 serving as a conveyance unit and a sub-scanning motor 416 for driving the conveyance belt 412.

The conveyance belt 412 attracts and conveys the paper 410 in a location that faces the liquid discharge head 404. The conveyance belt 412 is an endless belt and is stretched and installed between a conveyance roller 413 and a tension roller 414. The attraction may be electrostatic attraction or air suction, for example.

The conveyance belt 412 is moved circumferentially in the sub-scanning direction when the conveyance roller 413 is rotationally driven by the sub-scanning motor 416 via a timing belt 417 and a timing pulley 418.

Further, a maintenance and recovery mechanism 420 that maintains and recovers the liquid discharge head 404 is disposed lateral to the conveyance belt 412 in the main-scanning direction of the carriage 403.

The maintenance and recovery mechanism 420 includes a cap member 421 that caps a nozzle surface (where nozzles are formed) of the liquid discharge head 404, the wiper member 422 that wipes the nozzle surface, and the like.

The main-scanning movement mechanism 493, the supply mechanism 494, the maintenance and recovery mechanism 420, and the conveyance mechanism 495 are installed on a case that includes the side plates 491B and 491A and a back plate 491C.

In the apparatus configured in this manner, the paper 410 is fed and attracted to the conveyance belt 412. The paper 410 is conveyed in the sub-scanning direction by the circumferential movement of the conveyance belt 412.

Accordingly, the apparatus discharges liquid onto the stationary paper 410 to form an image by driving the liquid discharge head 404 in accordance with an image signal while moving the carriage 403 in the main-scanning direction.

Since this apparatus includes the liquid discharge head according to the present invention in this manner, the apparatus is capable of forming a high-quality image in a stable manner.

In the following, an example of another liquid discharge device according to the present invention is described with reference to FIG. 21. FIG. 21 is a plan view illustrating main elements of the liquid discharge device.

This liquid discharge device includes some members that constitute the apparatus for discharging liquid. Specifically, the liquid discharge device includes a case unit having the side plates 491B and 491A and the back plate 491C, the main-scanning movement mechanism 493, the carriage 403, and the liquid discharge head 404.

In addition, it is possible to constitute the liquid discharge device to which at least one of the maintenance and recovery mechanism 420 and the supply mechanism 494 is further attached to the side plate 491B of the liquid discharge device.

In the following, an example of yet another liquid discharge device according to the present invention is described with reference to FIG. 22. FIG. 22 is a front view illustrating the liquid discharge device.

This liquid discharge device includes the liquid discharge head 404 in which a channel part 444 is installed and the tube 456 connected to the channel part 444.

In addition, the channel part 444 is disposed within a cover 442. It is possible to include the head tank 441 instead of the channel part 444. Further, a connector 443 that electrically connects with the liquid discharge head 404 is disposed on an upper portion of the channel part 444.

In the present invention, the "apparatus for discharging liquid" is an apparatus that includes a liquid discharge head or a liquid discharge device and discharges liquid by driving the liquid discharge head. The apparatus for discharging liquid includes not only an apparatus capable of discharging liquid onto an object to which the liquid can be attached but also an apparatus for discharging liquid into a gas or into a liquid.

The "apparatus for discharging liquid" may include a unit related to feeding, conveyance, or ejection of an object to which liquid can be attached, a pretreatment unit, or a post-treatment unit, for example.

Examples of the "apparatus for discharging liquid" include an image formation apparatus which is an apparatus for forming an image on paper by discharging ink, and a stereoscopic shaping apparatus (three-dimensional modeling apparatus) that discharges a shaping liquid into a powder layer where powder is formed into a layer in order to shape a stereoscopic shaped object (three-dimensionally modeled object).

Further, the "apparatus for discharging liquid" is not limited to an apparatus that discharges liquid to visualize a character or a figure that has a meaning. For example, an apparatus that forms a pattern or the like that does not have a meaning and an apparatus that shapes three-dimensional image are also included in the "apparatus for discharging liquid".

The "object to which liquid can be attached" above means an object to which liquid can be at least temporarily attached. Materials for the "object to which liquid can be attached" may be of any type such as paper, string, fiber, cloth or fabric, leather, metal, plastic, glass, wood, ceramics, and the like as long as liquid can be at least temporarily attached thereto.

Further, examples of "liquid" include ink, a treatment liquid, a DNA sample, resist, a pattern material, a binding agent, a shaping liquid, and the like.

The "apparatus for discharging liquid" includes both a serial-type apparatus that moves the liquid discharge head and a line-type apparatus that does not move the liquid discharge head unless specified in particular.

Further, other examples of the "apparatus for discharging liquid" include a treatment liquid application apparatus that discharges a treatment liquid onto paper in order to apply the treatment liquid to a surface of the paper for the purpose of improving the surface of the paper, for example, an injection granulation apparatus that injects, via a nozzle, a composition liquid in which raw materials are dispersed in a solution in order to granulate fine particles of the raw materials.

The "liquid discharge device" includes the liquid discharge head integrated with a functional component or a mechanism. The "liquid discharge device" is an aggregation of components related to liquid discharge. Examples of the "liquid discharge device" include the liquid discharge head combined with at least one feature of the head tank, the carriage, the supply mechanism, the maintenance and recovery mechanism, and the main-scanning movement mechanism.

The integration here includes such a case where the liquid discharge head and the functional component or the mechanism are fixed relative to each other via joining, bonding, engagement, or the like and a case where one is movably held by another. Further, the liquid discharge head, the functional component, and the mechanism may be configured to be detachable from one another.

For example, in the liquid discharge device, the liquid discharge head and the head tank may be integrated as in the liquid discharge device 440 shown in FIG. 20. Further, the liquid discharge head and the head tank may be integrated by being connected to each other via a tube, for example. In this case, it is possible to additionally dispose a unit that includes a filter between the liquid discharge head and the head tank of the liquid discharge device.

Further, in the liquid discharge device, the liquid discharge head may be integrated with the carriage.

Further, in the liquid discharge device, the liquid discharge head may be movably held by the guide member that constitutes the main-scanning movement mechanism, so that the liquid discharge head is integrated with the main-scanning movement mechanism. Further, in the liquid discharge device, the liquid discharge head, the carriage, and the main-scanning movement mechanism may be integrated as shown in FIG. 21.

Further, in the liquid discharge device, the cap member serving a part of the maintenance and recovery mechanism may be fixed on the carriage where the liquid discharge head is installed, so that the liquid discharge head, the carriage, and the maintenance and recovery mechanism are integrated.

Further, in the liquid discharge device, the tube is connected to the liquid discharge head where the head tank or the channel part is installed, so that the liquid discharge head and the supply mechanism are integrated as shown in FIG. 22.

The main-scanning movement mechanism may include a single guide member. The supply mechanism may include a single tube or supply unit.

The pressure generation unit to be used for the "liquid discharge head" is not limited.

For example, other than the piezoelectric actuator (laminated-type piezoelectric element may also be used) as in the above-mentioned embodiments, a thermal actuator including an electrothermal conversion element such as a heating resistor or an electrostatic actuator including a vibration plate and a counter electrode may be used.

Further, in the present invention, terms such as image formation, recording, character printing, picture printing, printing, shaping, modeling, and the like are synonyms.

The present invention is not limited to the specifically disclosed embodiments, but various variations and modifications may be made without departing from the scope of the present invention.

The present application is based on and claims the benefit of priorities of Japanese Priority Patent Application No. 2014-217870 filed on Oct. 25, 2014 and Japanese Priority Patent Application No. 2015-146971 filed on Jul. 24, 2015, the entire contents of which are hereby incorporated by reference.

REFERENCE SIGNS LIST

1 nozzle plate
2 channel plate
3 vibration plate member
4 nozzle
6 individual liquid chamber
8 liquid introduction part
10 common liquid chamber
12 piezoelectric member
20 frame member
40 nozzle base member
41 nozzle hole
41*a* inner nozzle wall
42 liquid-repellent film
43 straight part
44 tapered part
43*a*, 44*a* wall portions
403 carriage
404 liquid discharge head
440 liquid discharge device

The invention claimed is:

1. A liquid discharge apparatus configured to perform discharge operation to discharge liquid, comprising:

a liquid supply to supply a liquid;

a nozzle base member including a plurality of nozzle holes formed therethrough, the plurality of nozzle holes serving as nozzles that, during the discharge operation of the liquid discharge apparatus, discharge droplets of the liquid supplied by the liquid supply; and a liquid-repellent film of a liquid-repellent material formed on a droplet discharge surface of the nozzle base member, the liquid-repellent material containing a liquid-repellent group, wherein each of the plurality of nozzle holes includes a straight hole part, the straight hole part extending from the droplet discharge surface of the nozzle base member and having a constant diameter in a thickness direction of the nozzle base member, wherein the liquid-repellent group contained in the liquid-repellent material is attached to an inner nozzle wall of the straight hole part, wherein for at least one nozzle hole, a central axis of the straight hole part of the nozzle hole is inclined by an inclination angle $\alpha$ relative to a direction perpendicular to the droplet discharge surface of the nozzle base member, where $0° \leq \alpha < 90°$, and wherein the nozzle hole is disposed and configured with a length L of the straight hole part, a diameter D of the nozzle hole, and a distance X from the droplet discharge surface to a liquid level of the liquid within the nozzle hole when the liquid is not being discharged from the plurality of nozzle holes, to comport with the following formula (1):

$$L \cdot \cos\alpha - (D \cdot \tan\alpha)/2 > X \cdot \cos\alpha \quad (1).$$

2. The liquid discharge apparatus as claimed in claim 1, wherein when the liquid supply supplies pure water, as the liquid, to the nozzle hole, a meniscus of the pure water stays in the straight hole part before a next discharge from the nozzle hole.

3. The liquid discharge apparatus as claimed in claim 1, wherein a region where a static contact angle $\theta$ with the liquid is 90° or more exists only in the straight hole part.

4. The liquid discharge apparatus as claimed in claim 1, wherein a film thickness of the liquid-repellent film is 5-30 nm.

5. The liquid discharge apparatus as claimed in claim 1, further comprising a plurality of concavities formed on the droplet discharge surface of the nozzle base member, wherein the liquid-repellent material that forms the liquid-repellent film is held with flowability in the concavities.

6. The liquid discharge apparatus as claimed in claim 1, wherein the liquid to be discharged from the liquid discharge apparatus includes a surface active agent and has a static surface tension of $30 \times 10^{-2}$ N/m or less.

7. A nozzle plate comprising:

a nozzle base member including at least one nozzle hole formed therethrough, to discharge liquid; and a liquid-repellent film of a liquid-repellent material containing a liquid-repellent group, wherein the nozzle hole includes (i) a straight hole part and (ii) a tapered part, wherein the liquid-repellent group contained in the liquid-repellent material is attached to the straight hole part and the tapered part, a central axis of the straight hole part is inclined by an inclination angle $\alpha$ ($0° \leq \alpha < 90°$) relative to a direction perpendicular to a discharge surface of the nozzle base member, and wherein the nozzle hole is configured to satisfy the following formula (1):

$$L \cdot \cos\alpha - (D \cdot \tan\alpha)/2 > X \cdot \cos\alpha \quad (1),$$

where a length of the straight hole part of the nozzle hole is L (μm), a diameter of the straight hole part of the nozzle hole is D (μm), a distance from the droplet discharge surface of the nozzle base member to a liquid level of the liquid within the nozzle hole is X (μm).

8. The nozzle plate as claimed in claim 7, wherein a region where a static contact angle $\theta$ with the liquid is 90° or more exists only in the straight hole part.

9. The nozzle plate as claimed in claim 7, wherein a film thickness of the liquid-repellent film is 5-30 nm.

10. The nozzle plate as claimed in claim 7, further comprising a plurality of concavities formed on a droplet discharge surface of the nozzle base member, wherein the liquid-repellent material that forms the liquid-repellent film is held with flowability in the concavities.

11. A liquid discharge head comprising the nozzle plate as claimed in claim 7.

12. A liquid discharge device comprising the liquid discharge head as claimed in claim 11.

13. The liquid discharge device as claimed in claim 12, wherein the liquid discharge head is integrated with at least one of a head tank that stores liquid to be supplied to the liquid discharge head, a carriage that carries the liquid discharge head, a supply mechanism that supplies liquid to the head tank, a maintenance and recovery mechanism that maintains and recovers the liquid discharge head, and a main-scanning movement mechanism that moves the liquid discharge head in a main-scanning direction.

14. An apparatus for discharging liquid, the apparatus comprising the liquid discharge head as claimed in claim 11.

15. The apparatus for discharging liquid as claimed in claim 14, wherein liquid to be discharged from the liquid discharge head includes a surface active agent and has a static surface tension of $30\times10^{-2}$ N/m or less.

* * * * *